US007204305B2

(12) United States Patent
Ricalton et al.

(10) Patent No.: US 7,204,305 B2
(45) Date of Patent: Apr. 17, 2007

(54) SYSTEM AND METHOD FOR INSTALLING A LINER IN A BOREHOLE

(75) Inventors: Allen E. Ricalton, Leduc (CA); Davor Majkovic, Edmonton, CA (US)

(73) Assignee: Smith International, Inc., Houston, TX (US)

( * ) Notice: Subject to any disclaimer, the term of this patent is extended or adjusted under 35 U.S.C. 154(b) by 283 days.

(21) Appl. No.: 10/864,272

(22) Filed: Jun. 9, 2004

(65) Prior Publication Data

US 2005/0211446 A1 Sep. 29, 2005

(30) Foreign Application Priority Data

Mar. 23, 2004 (CA) ..... 2462012

(51) Int. Cl.
*E21B 23/06* (2006.01)
*E21B 33/12* (2006.01)

(52) U.S. Cl. ..... 166/123; 166/181; 166/182; 166/129

(58) Field of Classification Search ..... 166/123, 166/181, 218, 219, 182, 129
See application file for complete search history.

(56) References Cited

U.S. PATENT DOCUMENTS 4,345,649 A 8/1982 Baugh et al.
4,487,258 A 12/1984 Jackson et al.
4,526,229 A 7/1985 Dickerson
4,660,637 A * 4/1987 McGill et al. ..... 166/120
4,669,538 A * 6/1987 Szarka ..... 166/120
4,862,957 A * 9/1989 Scranton ..... 166/51
4,936,387 A 6/1990 Rubbo
5,360,069 A * 11/1994 Schmuck et al. ..... 166/383
5,810,082 A 9/1998 Jordan, Jr.
5,826,661 A 10/1998 Parker et al.
6,119,783 A 9/2000 Parker et al.
6,612,372 B1 9/2003 Freiheit et al.
2004/0216877 A1* 11/2004 Pedersen et al. ..... 166/285

FOREIGN PATENT DOCUMENTS

CA 2407069 A1 11/2001

* cited by examiner

*Primary Examiner*—David Bagnell
*Assistant Examiner*—Nicole A Coy
(74) *Attorney, Agent, or Firm*—Conley Rose, P.C.

(57) ABSTRACT

A system and a method for installing a liner conduit in a borehole. The system includes a packer assembly, a running tool or a packer assembly and a running tool. The method uses a packer assembly and a running tool for installing a liner conduit in a borehole. The system and the method both use pressure to perform functions relating to the system and the method.

83 Claims, 21 Drawing Sheets

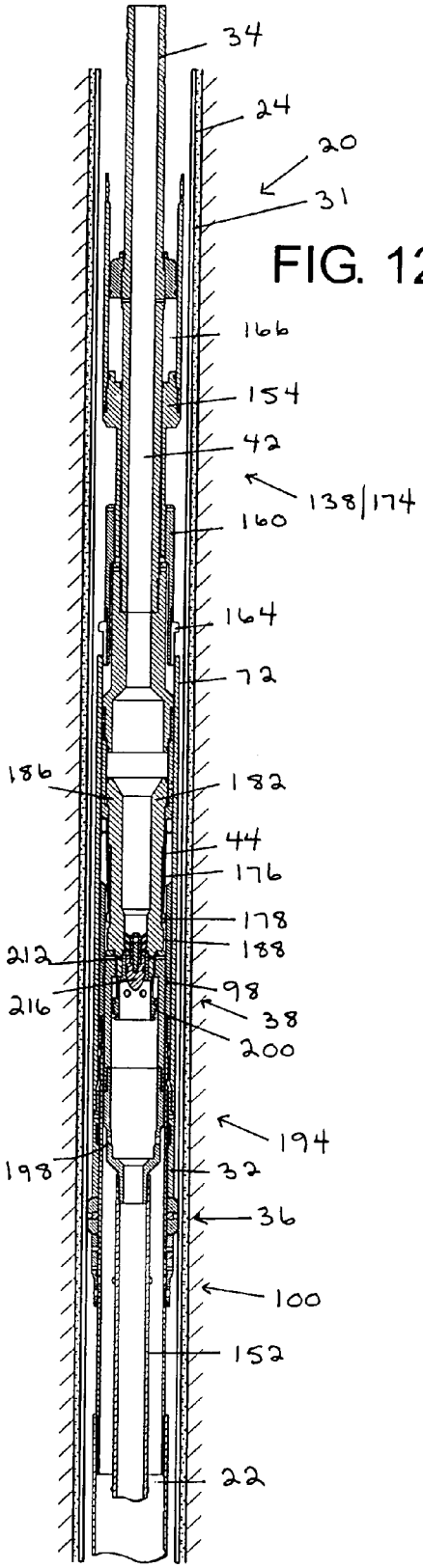
FIG. 12
FIG. 13
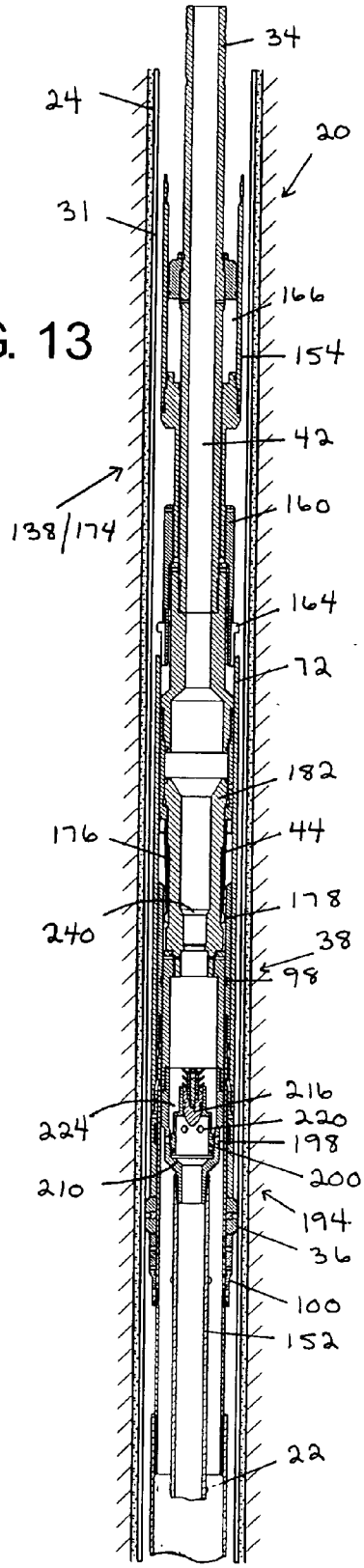

SYSTEM AND METHOD FOR INSTALLING A LINER IN A BOREHOLE

CROSS-REFERENCE TO RELATED APPLICATIONS

The present application claims priority to Canadian Application No. 2,462,012 filed on Mar. 23, 2004 and entitled "System and Method for Installing a Liner in a Borehole," hereby incorporated herein by reference for all purposes.

FIELD OF INVENTION

The present invention relates to a system and a method for installing a liner conduit in a borehole, preferably a long reach horizontal borehole. Further, the system is preferably comprised of at least one of a packer assembly adapted for insertion in the borehole with a running tool and a running tool adapted for insertion in the borehole with a packer assembly, both of which are actuated hydraulically. The method is preferably performed utilizing the within system.

BACKGROUND OF INVENTION

Directional drilling technology permits the drilling of a lateral or secondary borehole from a primary or mother borehole. Typically, lateral boreholes are drilled, and subsequently produced, through a gap or window cut or milled through a section of the existing casing string in the primary borehole. Alternately, the lateral borehole may extend from the downhole end of an existing casing string in the primary borehole. The lateral borehole thus extends from the primary borehole to a desired location in the formation.

The lateral borehole may be either cased or uncased. Where the lateral borehole is not fully cased, it may be desirable to hang or set a liner within the uncased portion of the lateral borehole to support the lateral borehole during production of the lateral borehole. In this case, the liner is preferably perforated to allow fluids to enter the lateral borehole for production to the surface.

Typically, an apparatus or mechanism is provided for hanging or otherwise positioning the liner within a casing string or other similar structure at or adjacent to the entrance to the lateral borehole, or within a portion of the lateral borehole itself, such that the liner extends within the lateral borehole. The apparatus also typically includes a packer or packer assembly for sealing the junction between the liner and the casing string.

Numerous packers or packing assemblies have been developed to provide the desired sealing effect within the borehole. Further, various mechanisms have been developed to install and actuate these packers in a desired position in the borehole. However, none have been found to be fully satisfactory.

For instance, the packer and attached liner are typically placed at a desired position within the borehole by a running tool connected with a working string extending from the surface. When in the desired position, the packer is set within the borehole and the running tool is removed to the surface with the working string.

However, the running tool with the packer may not be easily or readily insertable in the borehole due to the occurrence of a "piston" effect in the borehole during installation. To address the potential "piston" effect, the running tool and/or the packer may provide for a fluid bypass to permit fluids to pass through or past the running tool and/or the packer as they are being conducted downhole. However, it is often desirable to flush any drilling or other fluids from the lateral borehole following the installation of the liner and the packer and prior to the production of the lateral borehole. In this case, the presence of the fluid bypass may render any such desired flushing of the liner more difficult. As a result, a separate flushing tubing string is typically required to be subsequently inserted in the borehole to perform the flushing operation.

Thus, the absence of a fluid bypass may render the running tool and packer more difficult to conduct through the lateral borehole to the desired downhole position. However, the presence of the fluid bypass may render the subsequent flushing of the liner more difficult.

Further, the manner of actuating the packer and the releasing the running tool therefrom have not been found to be fully satisfactory. For instance, mechanically actuated or mechanically manipulated systems are typically used for setting the packer downhole and releasing the running tool. In other words, the working string is typically manipulated from the surface to actuate the packer and release the packer from the running tool mechanically downhole. For instance, a rotational force may be provided through rotation of the working string from the surface. As well, either tension or compression may be provided by moving the working string longitudinally in either an uphole or a downhole direction in the borehole. However, such mechanically actuated or mechanically manipulated systems may cause various difficulties.

For example, if the working string or any of the attached apparatus or liner becomes stuck within the borehole, it may not be possible to manipulate the working string in the desired manner to set the packer and/or release the running tool. Further, the packer is typically threadably connected with the running tool to be conducted downhole. Thus, manipulation of the working string, and particularly rotation of the working string, to set the packer may cause the packer to accidentally unthread from the running tool. Accordingly, such mechanically actuated systems may not always be desirable.

As well, the difficulties experienced with these mechanical systems may be intensified depending upon the orientation and depth of the borehole. Specifically, greater frictional resistance to the manipulation of the working string will tend to be encountered where the borehole is oriented more towards the horizontal and is of a significant length. In particular, the use of mechanical systems in long reach horizontal lateral boreholes has been found to be particularly challenging.

Examples of various forms of packers are provided by Canadian Patent Application No. 2,407,069 published Nov. 8, 2001 by Specialised Petroleum Services Group Limited, U.S. Pat. No. 4,345,649 issued Aug. 24, 1982 to Baugh et. al., U.S. Pat. No. 4,487,258 issued Dec. 11, 1984 to Jackson et. al., U.S. Pat. No. 4,526,229 issued Jul. 2, 1985 to Dickerson, U.S. Pat. No. 4,936,387 issued Jun. 26, 1990 to Rubbo, U.S. Pat. No. 5,810,082 issued Sep. 22, 1998 to Jordan, Jr., U.S. Pat. No. 5,826,661 issued Oct. 27, 1998 to Parker et. al., U.S. Pat. No. 6,119,783 issued Sep. 19, 2000 to Parker et. al. and U.S. Pat. No. 6,612,372 issued Sep. 2, 2003 to Freiheit et. al.

As a result, there remains a need in the industry for an improved system and an improved method for installing a liner conduit in a borehole. Further, there is a need for a hydraulically actuated system comprised of at least one of a packer assembly adapted for insertion in the borehole with a running tool and a running tool adapted for insertion in the borehole with a packer assembly. Finally, there is a need for a system and a method capable of installing a liner conduit in a long reach horizontal borehole.

SUMMARY OF INVENTION

The present invention is a system and a method for installing a liner conduit in a borehole. The system may be comprised of a packer assembly for sealing and/or anchoring the liner conduit in the borehole. Alternatively, the system may be comprised of a running tool for running the liner conduit and the packer assembly into the borehole. Alternatively, the system may be comprised of a packer assembly and a running tool. The method uses a packer assembly and a running tool for installing a liner conduit in a borehole.

The system and the method both use pressure to perform functions relating to the system and the method. The pressure may be applied in any suitable manner but is preferably applied to an interior of the running tool. In order to separately and/or sequentially perform more than one function relating to the system and the method, different pressures may be used to perform different functions. Alternatively, a single pressure may be used to perform a plurality of functions.

A packer assembly according to the invention is comprised of a packer sealing device for sealing the packer assembly in the borehole and a device for releasably connecting the packer assembly with a running tool. The device for releasably connecting the packer assembly with a running tool may be comprised of a packer latch device which is adapted to releasably engage a complementary running tool latch device which is associated with the running tool.

The packer assembly may be further comprised of a packer bypass device for bypassing a fluid from an exterior of the packer assembly to an interior of the packer assembly. The packer bypass device may be fixed in an open position or may be adapted to be actuatable from the open position to a closed position.

The packer assembly may also be further comprised of a structure, apparatus or device for transferring torque between the packer assembly and a running tool. The packer assembly may also be further comprised of a packer anchoring device for anchoring the packer assembly in the borehole.

A running tool according to the invention is comprised of a device for releasably connecting the running tool with a packer assembly. The device for releasably connecting the running tool with a packer assembly may be comprised of a running tool latch device which is adapted to releasably engage a complementary packer latch device associated with the packer assembly. The running tool may be further comprised of a packer sealing device actuator for actuating a packer sealing device which is associated with a packer assembly.

The running tool may be further comprised of a running tool bypass device for bypassing a fluid from an exterior of the running tool to an interior of the running tool. The running tool bypass device may be fixed in an open position or may be adapted to be actuatable from the open position to a closed position.

The running tool may also be further comprised of a structure, apparatus or device for transferring torque between a packer assembly and the running tool. The running tool may also be further comprised of a packer anchoring device actuator for actuating a packer anchoring device which is associated with a packer assembly.

A method according to the invention is comprised of the steps of inserting a system comprising a liner conduit, a packer assembly and a running tool in a borehole, using pressure to actuate a packer sealing device which is included in the packer assembly, and using pressure to disconnect the packer assembly from the running tool.

The method may be further comprised of the step of using pressure to actuate a packer bypass device. The method may be further comprised of the step of using pressure to actuate a running tool bypass device. The method may be further comprised of the step of using pressure to actuate a packer anchoring device. The method may be further comprised of the step of passing a circulating fluid through the running tool and through a circulating conduit.

In a first aspect, the invention is a system for installing a liner conduit in a borehole, the system comprising a packer assembly adapted for insertion in the borehole with a running tool, the packer assembly comprising:

(a) a packer sealing device, the packer sealing device being adapted to be actuatable from a collapsed configuration for positioning the packer assembly in the borehole to an expanded configuration for sealing the packer assembly in the borehole by the application of a packer sealing actuating pressure to an interior of the running tool; and (b) a packer latch device adapted to releasably engage a complementary running tool latch device on the running tool in order to releasably connect the packer assembly with the running tool, the packer latch device being adapted to disengage from the running tool latch device in order to disconnect the packer assembly from the running tool by the application of a latch actuating pressure to the interior of the running tool.

In a second aspect, the invention is a system for installing a liner conduit in a borehole, the system comprising a running tool adapted for insertion in the borehole with a packer assembly, the packer assembly comprising a packer sealing device and a packer latch device, the running tool comprising:

(a) a packer sealing device actuator adapted to actuate the packer sealing device from a collapsed configuration to an expanded configuration in response to the application of a packer sealing actuating pressure to an interior of the running tool; and (b) a running tool latch device adapted to releasably engage a complementary packer assembly latch device on the packer assembly in order to releasably connect the running tool with the packer assembly, the running tool latch device being adapted to disengage from the packer assembly latch device in order to disconnect the running tool from the packer assembly by the application of a latch actuating pressure to the interior of the running tool.

In a third aspect, the invention is a system comprising both a packer assembly and a running tool.

In a fourth aspect, the invention is a method for installing a liner conduit in a borehole, comprising:

(a) inserting a system comprising the liner conduit, a packer assembly and a running tool in the borehole, the packer assembly comprising a packer sealing device and a packer latch device, the running tool comprising a packer sealing device actuator and a running tool latch device, the liner conduit connected with the packer assembly, the packer assembly releasably connected with the running tool;

(b) applying a packer sealing actuating pressure to an interior of the running tool in order to actuate the packer sealing device to an expanded configuration in which the packer assembly is sealed in the borehole; and (c) applying a latch actuating pressure to the interior of the running tool in order to disengage the packer latch device from the running tool latch device, thereby disconnecting the packer assembly from the running tool.

The packer assembly may be further comprised of a packer bypass device for bypassing a fluid from an exterior of the packer assembly to an interior of the packer assembly. The packer bypass device may be fixed in an open position or may be adapted to be actuatable from an open position to a closed position by the application of a packer bypass actuating pressure to an interior of the running tool.

The packer bypass device may be comprised of any suitable structure, apparatus or device. Preferably the packer bypass device is comprised of a packer bypass port and a packer bypass valve for selectively closing the packer bypass port. The packer bypass device may be further comprised of a packer bypass restraining device for restraining actuation of the packer bypass valve before the application of the packer bypass actuating pressure. The packer bypass restraining device may be comprised of a shearable fastener or any other suitable structure, apparatus or device.

The packer assembly may be comprised of a tubular packer body, in which case the packer bypass port may be defined by the packer body and the packer bypass valve may be comprised of a movable shutoff sleeve carried by the packer body. The shutoff sleeve may be movable in any manner which is effective to close the packer bypass port. Preferably the shutoff sleeve is axially movable relative to the packer body in response to the application of the packer bypass actuating pressure.

The packer sealing device may be comprised of any suitable structure, apparatus or device which may be actuated from a collapsed configuration to an expanded configuration. Preferably the packer sealing device is comprised of an expandable sealing element which may be expanded in any suitable manner in order to provide the expanded configuration. For example, the sealing element may be expanded by inflation, by axial compression, or by the action of a camming surface or wedge.

Where the packer assembly is comprised of the packer body, the packer assembly may be further comprised of a movable setting sleeve carried by the packer body. The setting sleeve may be movable in response to the packer sealing actuating pressure in order to expand the sealing element and thereby actuate the packer sealing device to the expanded configuration. The setting sleeve may be movable in any manner which is effective to expand the sealing element. Preferably the setting sleeve is axially movable relative to the packer body and the sealing element is expanded by being axially compressed by the setting sleeve.

The packer sealing device may be further comprised of a packer sealing restraining device for restraining expansion of the sealing element before the application of the packer sealing actuating pressure. The packer sealing restraining device may be comprised of a shearable fastener or any other suitable structure, apparatus or device. In a preferred embodiment the packer sealing restraining device may be configured to fasten the setting sleeve to the packer body.

The packer sealing device may be further comprised of a packer locking mechanism for locking the packer sealing device in the expanded configuration. The packer locking mechanism may be comprised of any suitable structure, apparatus or device. Preferably the packer locking mechanism is comprised of a ratchet mechanism. In a preferred embodiment the ratchet mechanism is associated with the packer body and the setting sleeve.

The packer assembly may be further comprised of a packer anchoring device for anchoring the packer assembly in the borehole. The packer anchoring device may be comprised of any suitable structure, apparatus or device which may be actuated from a collapsed configuration to an anchoring configuration. Preferably the packer anchoring device is actuated by the use of pressure, such as by the application of a packer anchoring actuating pressure to the interior of the running tool. The packer anchoring actuating pressure may be the same pressure as the packer sealing actuating pressure or may be a different pressure. The packer anchoring device and the packer sealing device may be actuated in a related manner or independently, depending upon the design of the packer assembly.

The packer latch device and the running tool latch device may be comprised of any suitable structures, apparatus or devices which are capable of releasably connecting the packer assembly and the running tool upon the application of the latch actuating pressure.

Preferably the packer latch device is comprised of a latch groove defined by an interior surface of the packer body and the running tool latch device is comprised of a complementary collet which is adapted to releasably engage the latch groove.

The packer assembly and the running tool may be further comprised of a suitable structure, apparatus or device for transferring torque between the running tool and the packer assembly. The ability to transfer torque between the running tool and the packer assembly facilitates rotational manipulation of the packer assembly during the insertion and positioning of the system in the borehole.

Preferably the packer assembly is further comprised of a packer torque transfer surface and preferably the running tool is further comprised of a complementary running tool torque transfer surface. The torque transfer surfaces may be comprised of any suitable surface. Preferably the packer torque transfer surface is comprised of packer splines and the running tool torque transfer surface is comprised of complementary running tool splines. The packer splines may be associated with the packer body.

The system may be further comprised of the liner conduit. The liner conduit is preferably connected with the packer assembly so that the packer assembly and the liner conduit maintain a desired configuration. More preferably, the liner conduit is connected with the packer body so that the packer body and the liner conduit define a continuous path therethrough.

The liner conduit is preferably comprised of a perforated liner conduit but may alternatively be comprised of an unperforated liner conduit. The perforations may be formed in any suitable manner and may include holes, slots, screens, or a combination thereof.

The packer sealing actuating pressure, the packer anchoring actuating pressure, the latch actuating pressure and the packer bypass actuating pressure may each be different pressures so that the functions of the packer assembly can be performed separately, or two or more of the actuating pressures may be the same so that some or all of the functions of the packer assembly can be performed together. For example, in a preferred embodiment, the packer sealing actuating pressure and the packer bypass actuating pressure are comprised of a combined actuating pressure such that the application of the combined actuating pressure actuates both the packer bypass device and the packer sealing device.

Similarly, the components of the packer assembly may each be independent so that they are separately actuatable or two or more of the components may be related so that some or all of the components may be actuated together, such as by a related or shared actuator device.

For example, in a preferred embodiment the shutoff sleeve and the setting sleeve may be associated such that axial movement of the shutoff sleeve is caused by axial movement of the setting sleeve. Furthermore, in a preferred embodiment, the sealing element may be axially positioned between the shutoff sleeve and the setting sleeve so that the sealing element is axially compressed between the shutoff sleeve and the setting sleeve in response to the application of the packer sealing actuating pressure.

In this preferred embodiment, the packer sealing restraining device and/or the packer bypass restraining device may be configured to restrain movement of both the setting sleeve and the shutoff sleeve before the application of the packer sealing actuating pressure, the packer bypass actuating pressure or the combined actuating pressure. The packer sealing restraining device and the packer bypass restraining device may also be comprised of a single restraining device such as one or more shearable fasteners associated with either or both of the setting sleeve and the shutoff sleeve.

Where the packer assembly is comprised of a packer bypass device which is actuatable from an open position to a closed position, the running tool may be further comprised of a packer bypass device actuator which is adapted to actuate the packer bypass device to the closed position in response to the application of the packer bypass actuating pressure. The packer bypass device actuator may be comprised of any suitable structure, apparatus or device which is compatible with the packer bypass device.

The running tool may be further comprised of a tubular running tool body, in which case the packer bypass device actuator may be comprised of a movable actuating piston device carried by the running tool body. The actuating piston device may be movable in any manner which is effective to actuate the packer bypass device, but is preferably axially movable relative to the running tool body in response to the application of the packer bypass actuating pressure.

In a preferred embodiment, the running tool body and the actuating piston device define a piston chamber and the running tool body defines a piston chamber port extending between the interior of the running tool and the piston chamber. The piston chamber port therefore communicates pressure from the interior of the running tool to the piston chamber, which in turn causes the actuating piston device to tend to move axially relative to the running tool body in response to the pressure.

The actuating piston device may actuate the packer bypass device in any suitable manner in response to the application of the packer bypass actuating pressure. Preferably, the actuating piston device is comprised of a piston engagement surface for engaging with the packer assembly in order to actuate the packer bypass device. Preferably the piston engagement surface is comprised of a shoulder which engages with a complementary surface on the packer assembly.

The packer sealing device actuator may be comprised of any suitable structure, apparatus or device which is compatible with the packer sealing device. Where the running tool is comprised of the running tool body, the packer sealing device actuator may be comprised of a movable actuating piston device carried by the running tool body. The actuating piston device may be movable in any manner which is effective to actuate the packer sealing device, but is preferably axially movable relative to the running tool body in response to the application of the packer sealing actuating pressure.

The actuating piston device for the packer sealing device may be comprised of a device which is similar or identical to the actuating piston device for the packer bypass device as described above.

In a preferred embodiment the actuating piston device for each of the packer sealing device and the packer bypass device is comprised of a single actuating piston device which actuates both the packer sealing device and the packer bypass device. As a result, in this preferred embodiment, the actuating piston device is comprised of a piston engagement surface which engages with the setting sleeve and moves axially in response to the application of the combined actuating pressure in order to expand the sealing element and to axially move the shutoff sleeve to close the packer bypass port.

Where the packer assembly includes a packer anchoring device, the running tool may be further comprised of a packer anchoring device actuator. The packer anchoring device actuator may be comprised of any suitable structure, apparatus or device which is compatible with the packer anchoring device. Depending upon the design of the packer sealing device and the packer anchoring device, the packer anchoring device actuator may be independent of the packer sealing device actuator or may be related to the packer sealing device actuator. The packer sealing device actuator and the packer anchoring device actuator may also be comprised of a single actuator which actuates both the packer sealing device and the packer anchoring device.

The running tool is preferably further comprised of a running tool bypass device for bypassing a fluid from an exterior of the running tool to the interior of the running tool. The running tool bypass device may be fixed in an open position or may be actuatable from an open position to a closed position by the application of a running tool bypass actuating pressure to the interior of the running tool. The ability to actuate the running tool bypass device from the open position to the closed position provides an opportunity for the system to be used to circulate a circulating fluid through the liner conduit after it has been installed in the borehole without first removing the running tool from the borehole.

The running tool bypass actuating pressure may be a pressure which is different from each of the packer sealing actuating pressure, the packer anchoring actuating pressure, the latch actuating pressure and the packer bypass pressure. Alternatively, the running tool bypass actuating pressure may be a pressure which is the same as one or more of these other actuating pressures. Preferably the running tool bypass actuating pressure is a pressure which is different from each of the other actuating pressures.

The running tool bypass device may be comprised of any suitable structure, apparatus or device. Preferably the running tool bypass device is comprised of a running tool bypass port and a running tool bypass valve for selectively closing the running tool bypass port. The running tool bypass device may be further comprised of a running tool bypass restraining device for restraining actuation of the running tool bypass valve before the application of the running tool bypass actuating pressure. The running tool bypass restraining device may be comprised of a shearable fastener or any other suitable structure, apparatus or device.

Where the running tool is comprised of the running tool body, the running tool bypass port may be defined by the running tool body and the running tool bypass valve may be comprised of a movable shutoff member carried by the running tool body. The shutoff member may be movable in any manner which is effective to close the running tool bypass port.

In a preferred embodiment the movable shutoff member may be comprised of a shutoff piston which is contained within the running tool body, which shutoff piston may be axially movable relative to the running tool body in response to the application of the running tool bypass actuating pressure in order to close the running tool bypass port. In the preferred embodiment, the running tool bypass restraining device fastens the shutoff piston to the running tool body until the application of the running tool bypass actuating pressure.

The system may be further comprised of a circulating conduit which may be connected with the running tool. Where the running tool is comprised of the running tool body the circulating conduit is preferably connected with the running tool so that the running tool body and the circulating conduit define a continuous passage therethrough. The continuous passage provides a flowpath for a circulating fluid so that the circulating fluid can be passed downward through the running tool and the circulating conduit and back upward through the liner conduit.

The circulating conduit facilitates the passing of the circulating fluid through the liner conduit after the liner conduit has been installed in the borehole but before the running tool has been removed from the borehole. The circulating conduit is particularly beneficial where the liner conduit is a perforated liner conduit since the perforations will interfere with the passing of circulating fluid directly through the liner conduit. The inclusion of the circulating conduit as part of the system also provides an opportunity for the liner conduit to be installed in the borehole and for the circulating fluid to be passed through the liner conduit in a single operation without the need first to remove the running tool from the borehole and then to insert a separate circulating conduit into the borehole.

Where the system is comprised of the circulating conduit and the running tool is comprised of the running tool bypass device, the running tool bypass device is preferably actuatable from the open position to the closed position. Where the system is comprised of the circulating conduit and the packer assembly is comprised of the packer bypass device, the packer bypass device is also preferably actuatable from the open position to the closed position.

More particularly, the running tool bypass device is preferably actuatable from the open position to the closed position in a manner such that when the running tool bypass device is in the closed position, the circulating fluid may be passed through the running tool and the circulating conduit.

The system facilitates the application of the various actuating pressures for performing the various functions of the packer assembly and the running tool. Preferably, the interior of the running tool defines a flowpath therethrough, which flowpath may be obstructed in order to create a backpressure to facilitate the application of the various actuating pressures. Where the system is comprised of the circulating conduit, preferably the obstruction of the flowpath through the interior of the running tool either does not prevent the passing of the circulating fluid through the running tool and the circulating conduit, or the obstruction may be lessened or eliminated to enable the passing of the circulating fluid. The flowpath may be obstructed in any suitable manner which achieves these goals.

Preferably, the flowpath is obstructed by a setting plug which is passed through the interior of the running tool. As a result, preferably the interior of the running tool is comprised of a setting plug landing surface which is adapted to accept the setting plug. The setting plug may be comprised of any suitable structure, apparatus or device and the setting plug landing surface may be comprised of any surface which is compatible with the setting plug.

Preferably the setting plug landing surface is associated with the running tool bypass device. More preferably the setting plug landing surface is associated with the running tool bypass valve so that the actuation of the running tool bypass device to the closed position also results in a lessening or elimination of the obstruction of the interior of the running tool.

In a preferred embodiment, the running tool bypass valve defines a bypass valve flowbore extending therethrough and the setting plug landing surface is associated with the bypass valve flowbore so that the setting plug will obstruct the bypass valve flowbore. Preferably the running tool bypass valve defines a circulating port extending from an exterior of the running tool bypass valve to the bypass valve flowbore, which circulating port is exposed when the running tool bypass device is in the closed position. Preferably the running tool bypass device is further comprised of a bypass chamber and the bypass chamber is configured so that a circulating fluid may be passed through the circulating port when the setting plug is landed in the setting plug landing surface and the running tool bypass device is in the closed position.

The running tool may be further comprised of a latch device actuator which is adapted to disengage the running tool latch device from the packer assembly latch device in response to the application of the latch actuating pressure.

The latch device actuator may by comprised of any suitable structure, apparatus or device. The latch device actuator may be comprised of a movable latch actuating member. The latch actuating member may be movable in any manner which is effective to cause the packer latch device and the running tool latch device to disengage from each other. Where the running tool is comprised of the running tool body, the latch actuating member may be carried by the running tool body.

In a preferred embodiment the latch actuating member may be comprised of a latch releasing piston which is contained within the running tool body. The latch releasing piston is preferably axially movable relative to the running tool body in response to the application of the latch actuating pressure in order to disengage the packer latch device and the running tool latch device. Where the packer latch device and the running tool latch device are comprised of a latch groove and a collet, the latch releasing piston may define a collet retaining groove and axial movement of the latch releasing piston may cause the collet to enter the collet retaining groove and thereby disengage from the latch groove.

The latch device actuator may be further comprised of a latch actuating restraining device for restraining movement of the latch device actuator before the application of the latch actuating pressure. The latch actuating restraining device may be comprised of a shearable fastener or any other suitable structure, apparatus or device. In a preferred embodiment the latch actuating restraining device fastens the latch releasing piston to the running tool body until the application of the latch actuating pressure.

The method of the invention may be further comprised of the step of removing the running tool from the borehole.

Where the system is comprised of the circulating conduit, the method may be further comprised of the step of removing the running tool and the circulating conduit from the borehole.

The method of the invention may be further comprised of the step of obstructing the interior of the running tool in order to facilitate the application of various pressures. The obstructing step may be performed in any suitable manner. Preferably the obstructing step is comprised of passing a setting plug through the interior of the running tool to a setting plug landing surface associated with the running tool.

The method of the invention may be further comprised of the step of applying a packer bypass actuating pressure to the interior of the running tool in order to actuate a packer bypass device to a closed position.

The method of the invention may be further comprised of the step of applying a running tool bypass actuating pressure to the interior of the running tool in order to actuate a running tool bypass device to a closed position.

The method of the invention may be further comprised of the step of applying a packer anchoring actuating pressure to the interior of the running tool in order to actuate a packer anchoring device to an anchored configuration.

Where the system is comprised of a circulating conduit, the method may be further comprised of the step of passing a circulating fluid through the running tool and the circulating conduit. Where the method is comprised of the step of passing the circulating fluid through the running tool and the circulating conduit, the method may be further comprised of the step of lifting the running tool relative to the liner conduit before the circulating fluid passing step in order to provide for a sufficient flowpath in the liner conduit to permit the circulating fluid to move upward through the liner conduit.

The steps of the invention may be performed in any suitable order. Preferably the step of applying the packer sealing actuating pressure is performed before the step of applying the latch actuating pressure. Preferably the step of applying the running tool bypass actuating pressure is performed before the step of passing the circulating fluid through the running tool and the circulating conduit. Preferably the step of applying the packer bypass actuating pressure is performed before the step of passing the circulating fluid through the running tool and the circulating conduit.

Preferably the packer bypass actuating pressure and the packer sealing actuating pressure are comprised of a combined actuating pressure such that the application of the combined actuating pressure actuates both the packer bypass device and the packer sealing device. Preferably the combined actuating pressure actuates the packer bypass device before actuating the packer sealing device.

BRIEF DESCRIPTION OF DRAWINGS

Embodiments of the invention will now be described with reference to the accompanying drawings, in which:

FIG. 5 is a detailed cross-sectional view of the packer assembly of FIG. 2, wherein

FIG. 6 is a detailed cross-sectional view of the running tool of FIG. 3, wherein

FIG. 7 is a detailed cross-sectional view of the packer assembly and running tool of FIG. 4, wherein

FIGS. 8 through 14 show a sequence of steps of a preferred embodiment of the method of the within invention performed using the system shown in FIG. 1;

FIG. 17 is a detailed view of a packer bypass device of the packer assembly shown in FIG. 1; wherein FIG. 17A shows the packer bypass device in an open position as in FIG. 8 and wherein

FIG. 18 is a detailed view of a packer latch device of the packer assembly and a running tool latch device of the running tool shown in FIG. 1; wherein FIG. 18A shows the packer latch device and the running tool latch device in an engaged position as in FIG. 8, wherein FIG. 18B shows the packer latch device and the running tool latch device in a disengaged position as in FIG. 11 and wherein

FIG. 19 is a detailed view of a running tool bypass device of the running tool shown in FIG. 1 having a setting plug landed therein; wherein FIG. 19A shows the running tool bypass device in an open position as in FIG. 10 and wherein

DETAILED DESCRIPTION

Figure 1:
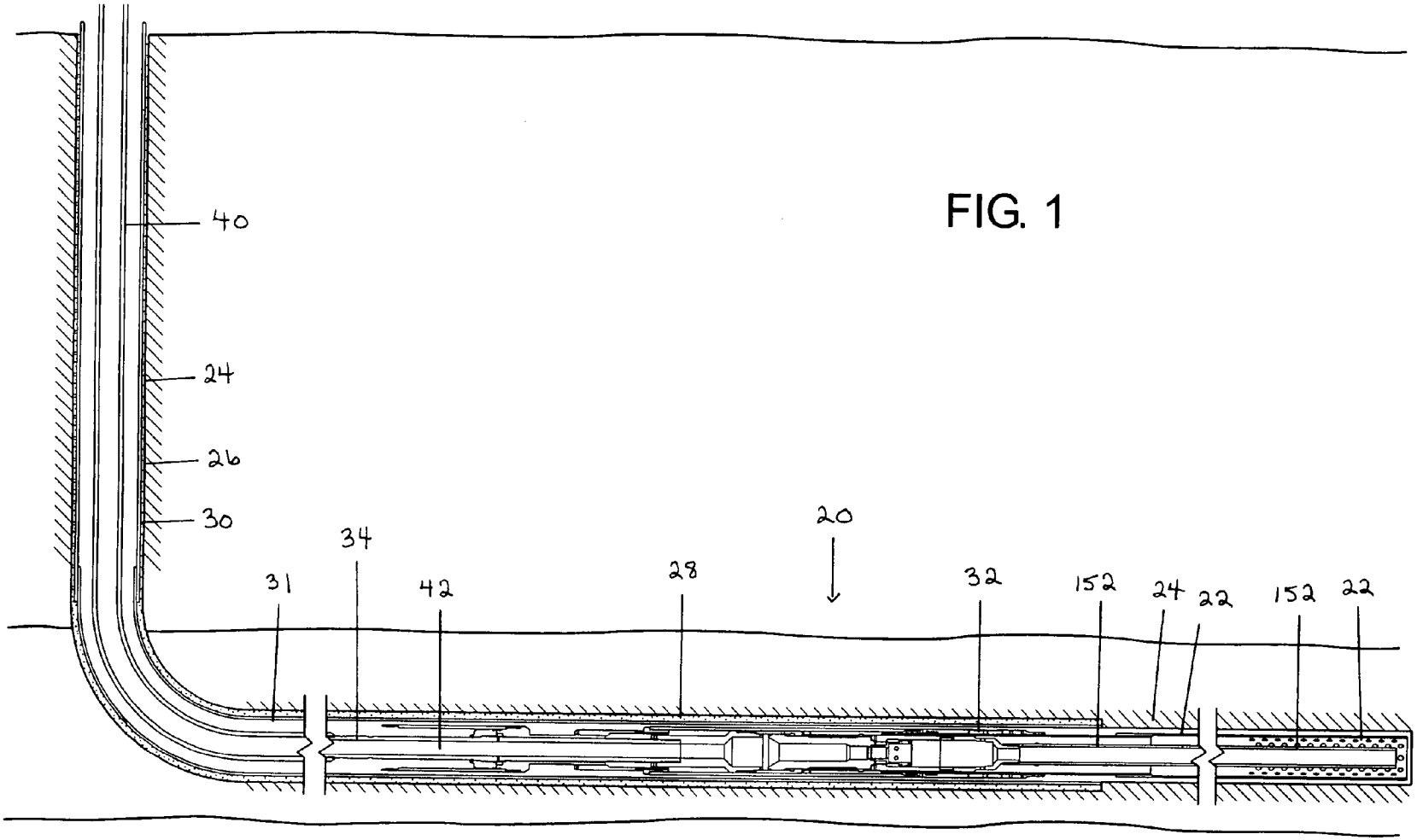
FIG. 1 is a pictorial view of a preferred embodiment of the system of the within invention within a borehole, wherein the system is comprised of a packer assembly and a running tool.
Figure 2:
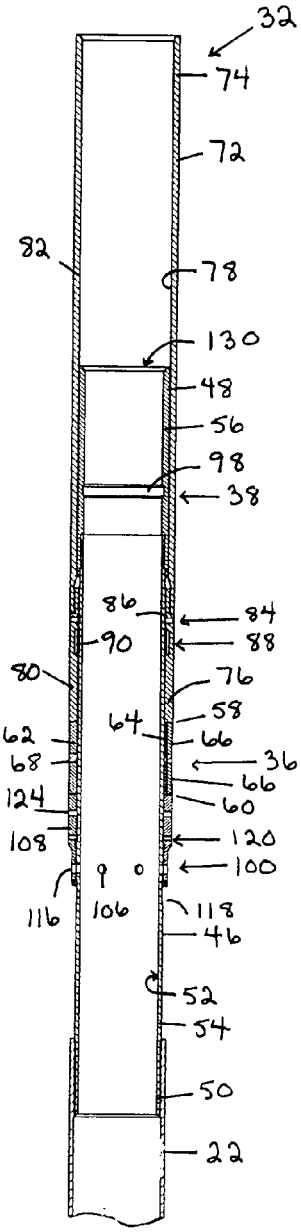
FIG. 2 is a cross-sectional view of the packer assembly shown in FIG. 1, in isolation.
Figure 3:
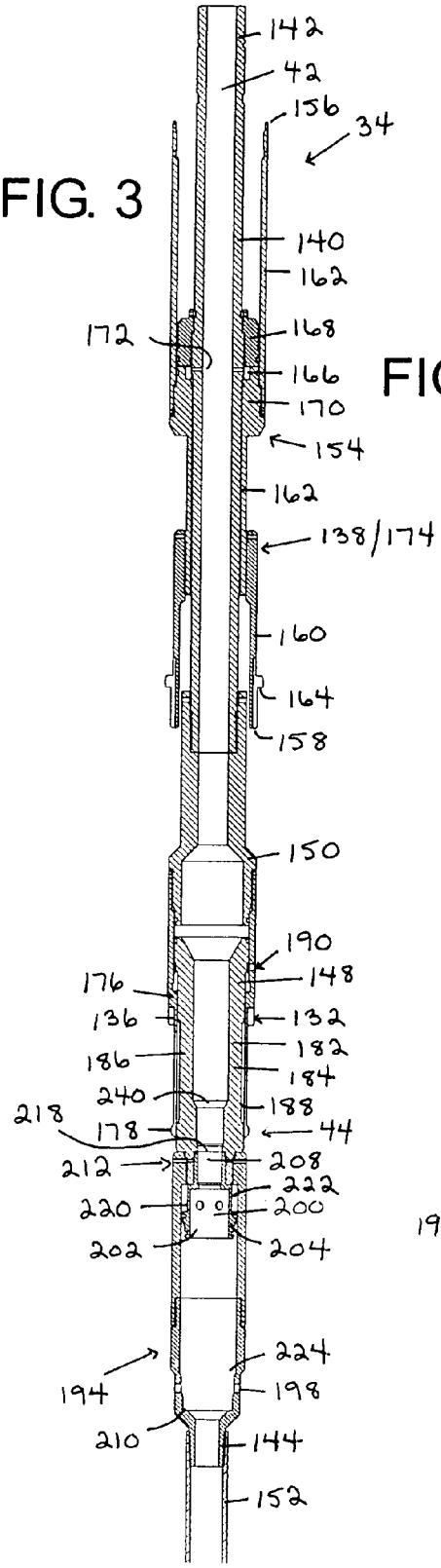
FIG. 3 is a cross-sectional view of the running tool shown in FIG. 1, in isolation.
Figure 4:
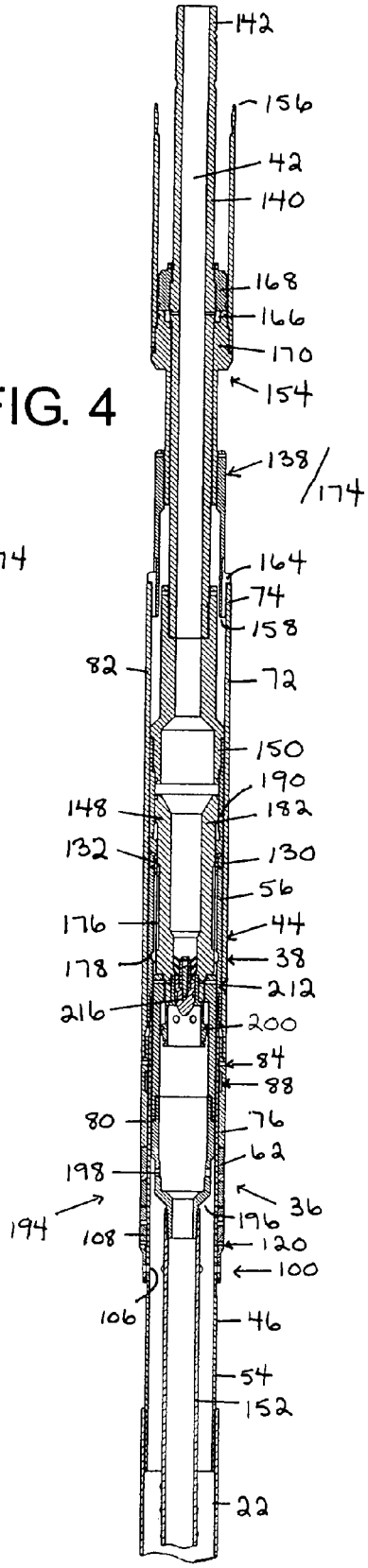
FIG. 4 is a cross-sectional view of the packer assembly of FIG. 2 releasably connected with the running tool of FIG. 3.

Referring to FIGS. 1 and 8–14, the within invention is directed at a system (20) and a method for installing a liner conduit (22) in a borehole (24). The liner conduit (22) may be installed or positioned at any location along the length of the borehole (24). However, preferably, the borehole (24) is comprised of a primary borehole section (26) extending from the surface to a desired depth and at least one lateral borehole section (28) extending from the primary borehole section (26). The lateral borehole section (28) may extend from the primary borehole section (26) at any angle and may be oriented in any direction relative to the surface. However, preferably, the lateral borehole section (28) is not oriented vertically or perpendicular to the ground surface. Rather, the lateral borehole section (28) is preferably deviated from the vertical. In the preferred embodiment, the lateral borehole section (28) is oriented in a generally or substantially horizontal direction.

Thus, the system (20) and the method are preferably utilized for the installation of the liner conduit (22) in the lateral borehole section (28) of the borehole (24). In the preferred embodiment, the lateral borehole section (28) is comprised of a long reach horizontal lateral borehole. The within invention is particularly suited for use in such horizontal lateral wells as it addresses various of the difficulties or problems associated with mechanically manipulating conventional packer assemblies and systems downhole to actuate them given the frictional forces encountered by such systems in laterally oriented boreholes. Further, in the preferred embodiment, the system (20) and the method of the within invention are particularly intended for use in Steam Assisted Gravity Drainage ("SAGD") wells, wherein the system (20) and the method are particularly utilized for the installation of the liner conduit (22) in the lateral section or portion of the SAGD well.

Further, the borehole (24), including each of the primary borehole section (26) and the lateral borehole section (28), may be cased, uncased or a combination thereof. As shown in FIG. 1, the primary borehole section (26) is preferably cased, being comprised of a casing string (30) extending from the surface to the junction of the primary borehole and lateral borehole sections (26, 28). Further, the lateral borehole section (28) preferably includes a cased portion and an uncased portion. Thus, the lateral borehole section (28) is also preferably comprised of a casing string (31) which is connected with the casing string (30) in the primary borehole section (26) and extends from the junction to the uncased or open hole portion of the lateral borehole section (28). The liner conduit (22) preferably extends through the casing string (31) in the lateral borehole string (28) and into the uncased portion thereof in order to provide support to the lateral borehole wall.

In addition, the liner conduit (22) may be comprised of any type of liner or tubing or production string suitable for use in the production of the borehole (24). Preferably, the liner conduit (22) extends within the uncased portion of the lateral borehole section (28) of the borehole (24). Thus, the liner conduit (22) is preferably comprised of a liner or tubing or production string suitable for use in the production of fluids therefrom. The liner conduit (22) therefore preferably provides support to the uncased lateral borehole section (28), while allowing fluids to enter or pass into the lateral borehole section (28) for production to the surface. Preferably, the liner conduit (22) is comprised of a perforated liner conduit. However, in the preferred embodiment, the liner conduit (22) is also comprised of a length of unperforated liner conduit which is positioned between the system (20) and the perforated portion of the liner conduit. Typically, the unperforated liner conduit extends for a length of about 100 to 130 meters from the system (20) into the lateral borehole section (28).

The system (20) is comprised of at least one of a packer assembly (32) adapted for insertion in the borehole (24) with a running tool (34) and a running tool (34) adapted for insertion in the borehole (24) with a packer assembly (32). However, preferably, the system (20) is comprised of both the packer assembly (32) and the running tool (34) which are configured to complement each other and to act together.

The running tool (34) is utilized for running the packer assembly (32), and the liner conduit (22) connected therewith, into the borehole (24) to the desired position. The packer assembly (32) is provided for sealing the liner conduit (22) in the borehole (24) at the desired position. The packer assembly (32) may be sealed with the borehole (24) at any location along the length thereof. However, preferably, the packer assembly (32) is positioned within the lateral borehole section (28) and sealed with the adjacent casing string (31) such that the liner conduit (22) may extend within the uncased or open hole portion of the lateral borehole section (28) as shown in FIG. 1.

The packer assembly (32) is provided primarily for the sealing function as described above. In the preferred embodiment, given the desired configuration of the borehole and the intended use of the system (20) for long reach horizontal boreholes, a mechanical connection may not be required to anchor the packer assembly (32) or the liner conduit (22) within the borehole (24). However, where desired or required to maintain the packer assembly (32) and the liner conduit (22) attached therewith in position within the borehole (24), the packer assembly (32) may include a mechanism for mechanically connecting or anchoring the liner conduit (22) with the borehole (24). For instance, the packer assembly (32) may be comprised of anchoring slips or any known or conventional anchoring structure capable of providing the desired mechanical connection.

Referring to FIGS. 2, 4, 5, 7, 17 and 18 of the packer assembly (32), the packer assembly (32) is preferably comprised of a packer sealing device (36) for sealing the packer assembly (32) within the borehole (24) and a packer latch device (38) for releasably connecting the packer assembly (32) with the running tool (34). Although each of the packer sealing device (36) and the packer latch device (38) may be actuated in any manner and by any mechanism, each are preferably actuated hydraulically. In particular, each of the packer sealing device (36) and the packer latch device (38) are actuated by the application of fluid pressure to the running tool (34).

More particularly, the running tool (34) is connected with a working string (40) to be inserted in the borehole (24), wherein the working string (40) is comprised of tubing or a tubing string which extends from the surface to the running tool (34) downhole. Further, a continuous flow path or a continuous passage for fluids is provided between the working string (40) and the running tool (34). Thus, fluids may be conducted downhole to the running tool (34) through the working string (40). In this regard, the running tool (34) has an interior (42) which defines the fluid flow path or continuous passage therethrough for conducting fluids through the running tool (34). The packer assembly (32), including each of the packer sealing device (36) and the packer latch device (38), are actuated by the application of fluid pressure to the interior (42) of the running tool (34).

Figure 5A:
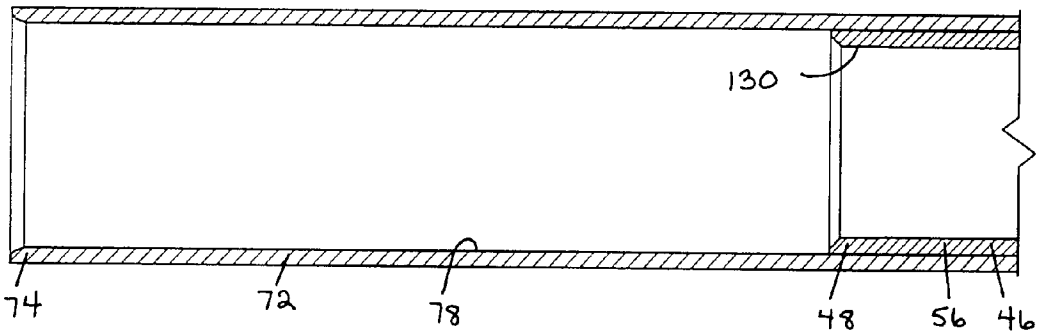
Figure 5B:
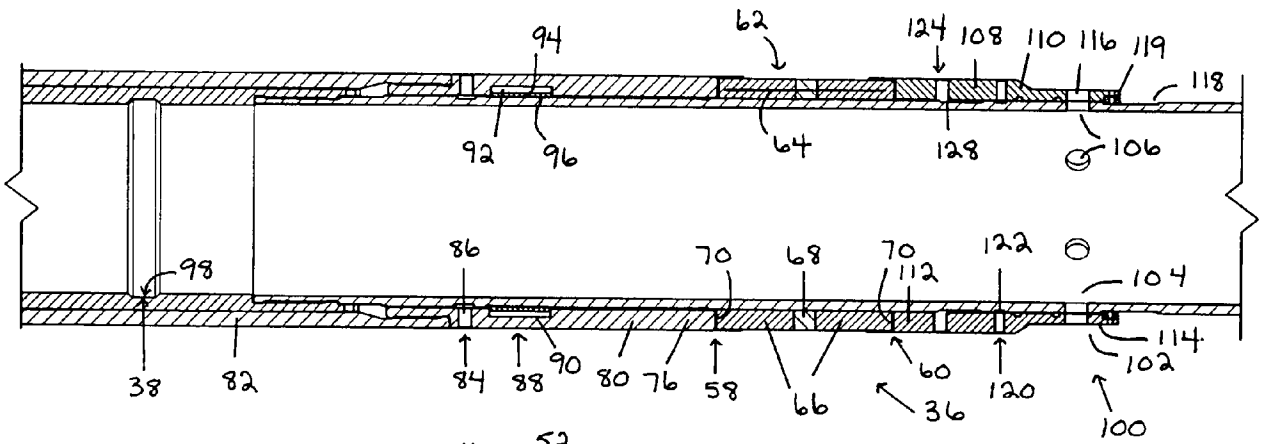
FIGS. 5B and 5C are lower continuations of FIGS. 5A and 5B respectively.
Figure 5C:
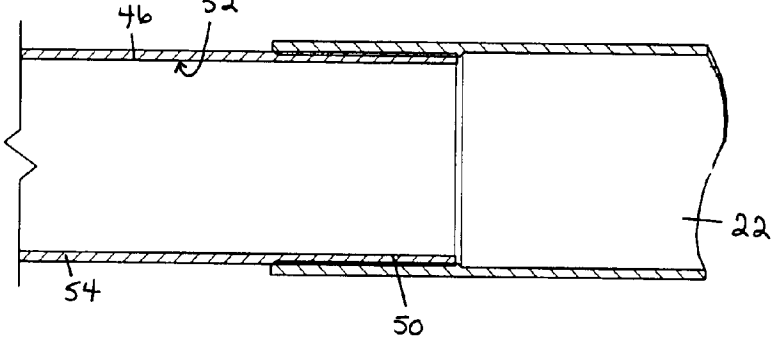
Figure 6A:
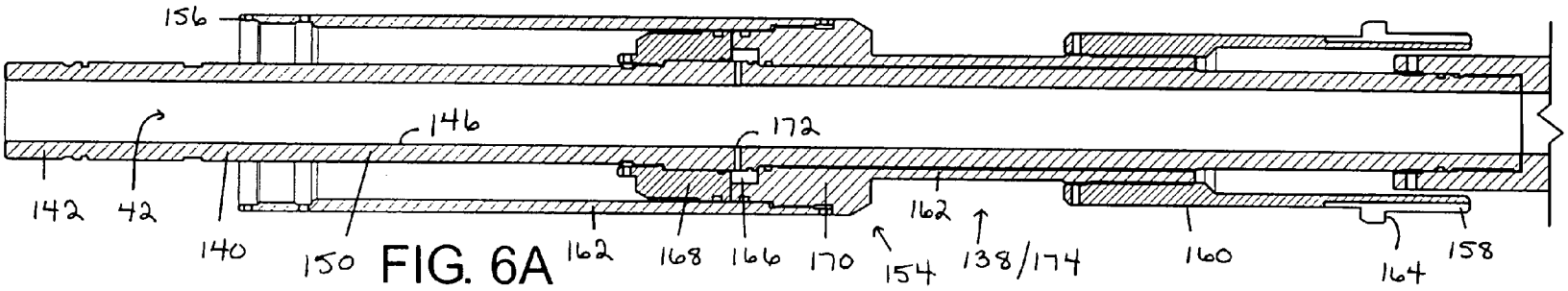
Figure 6B:
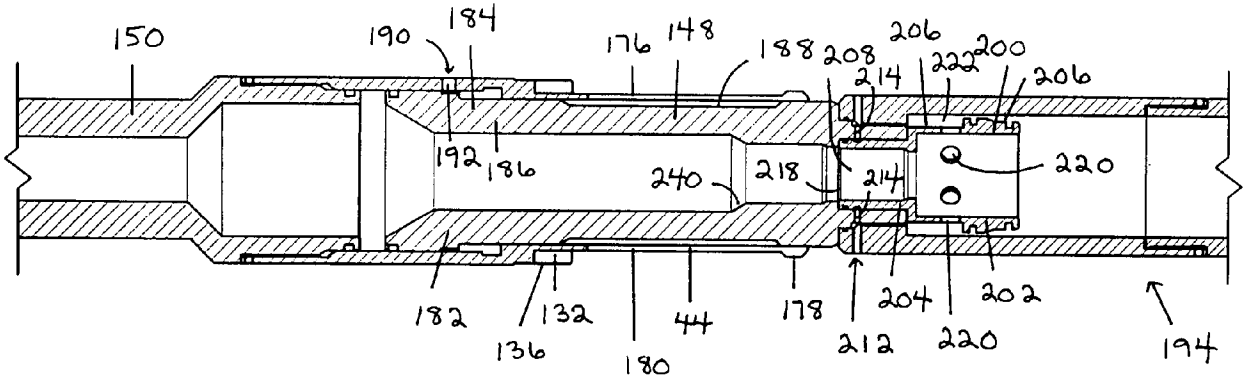
FIGS. 6B and 6C are lower continuations of FIGS. 6A and 6B respectively.
Figure 6C:
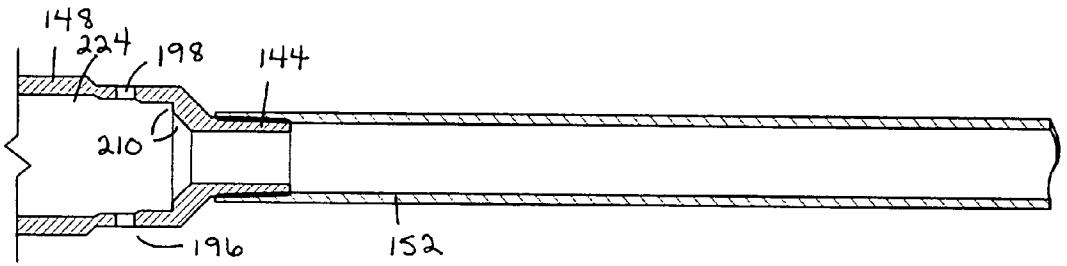
Figure 7A:
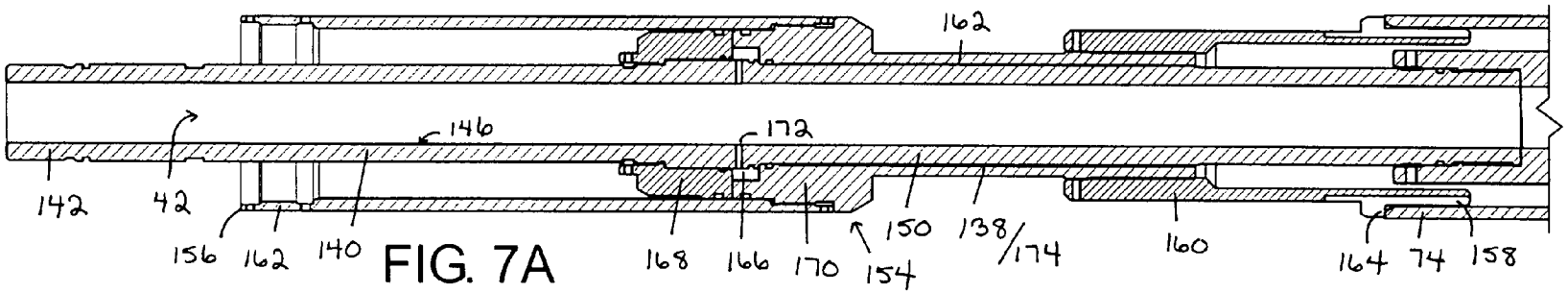
Figure 7B:
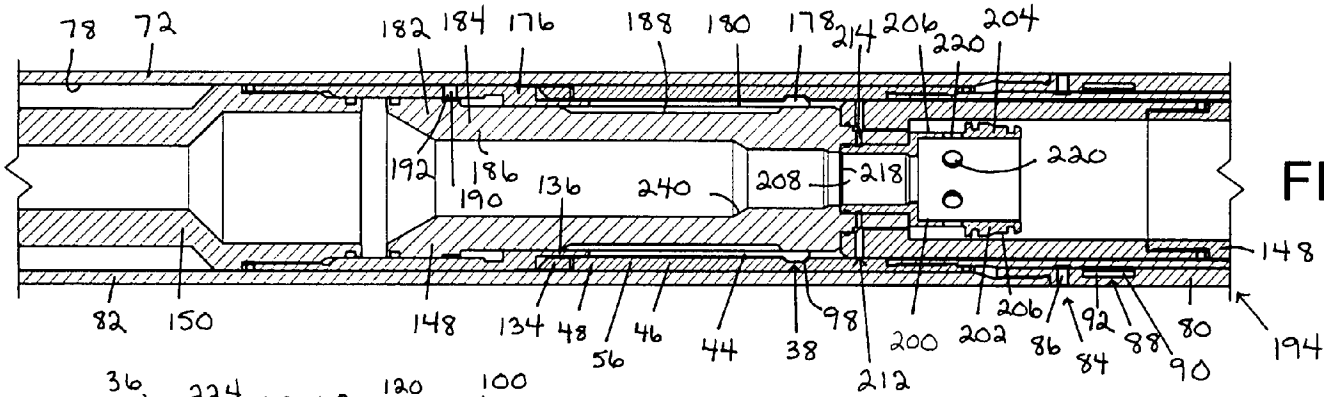
FIGS. 7B and 7C are lower continuations of FIGS. 7A and 7B respectively.
Figure 7C:
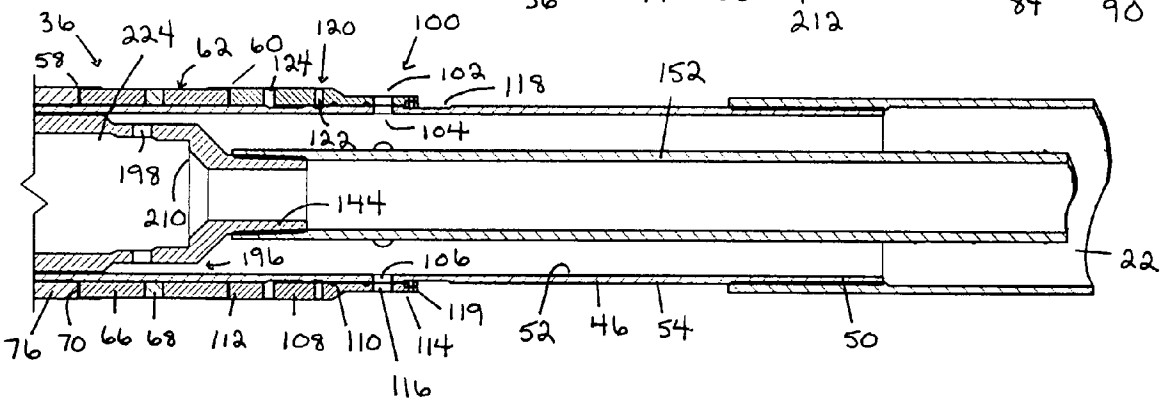
Figure 8:
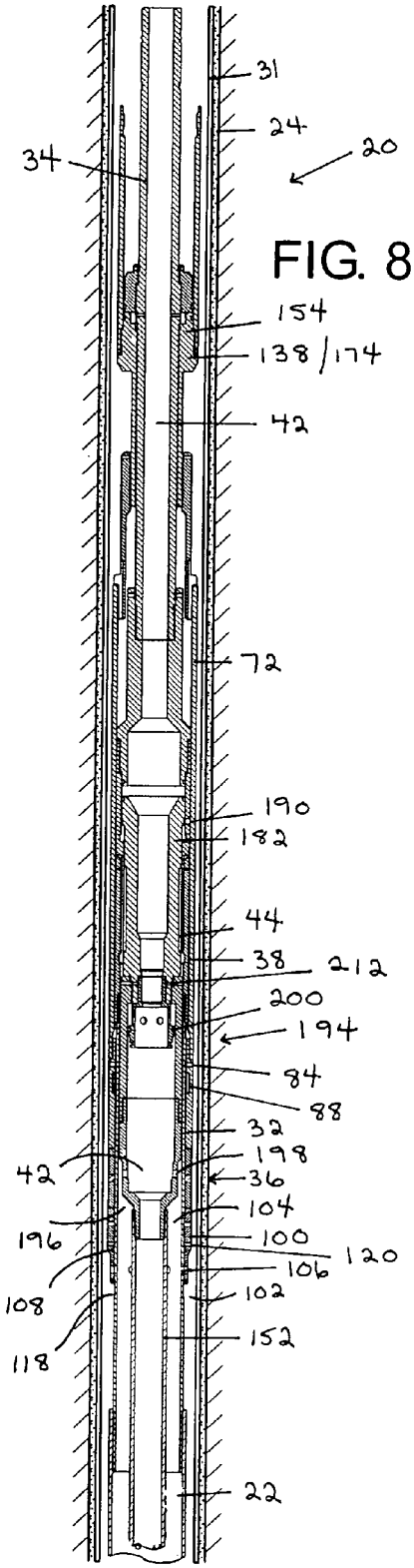
Figure 10:
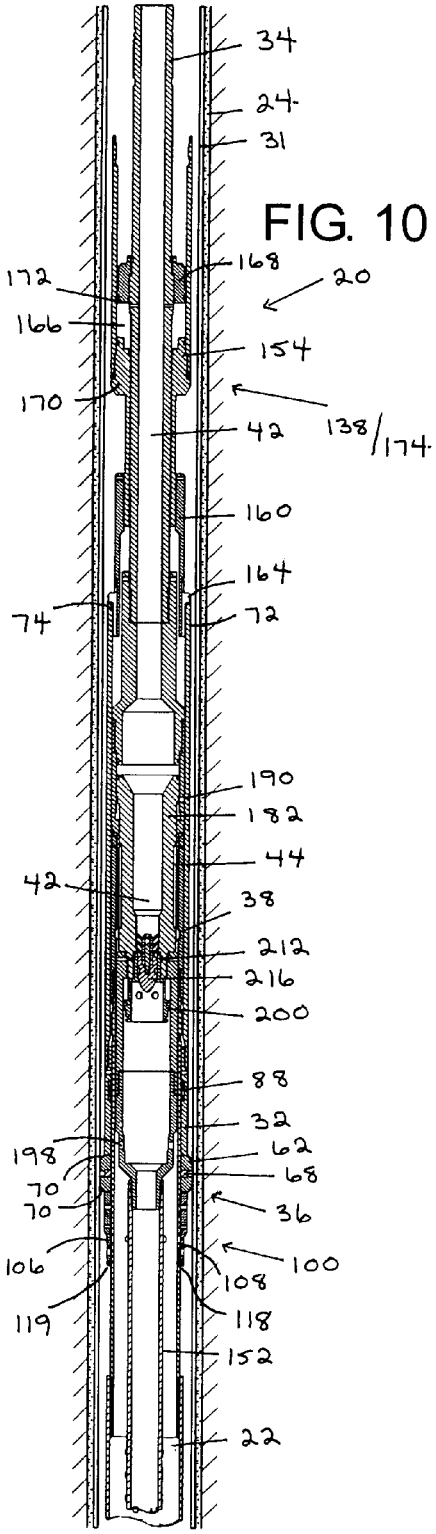

The packer sealing device (36) is adapted to be actuatable from a collapsed configuration, as shown in FIGS. 5 and 8, for positioning the packer assembly (32) in the borehole (24) to an expanded configuration, as shown in FIG. 10, for sealing the packer assembly (32) in the borehole (24) by the application of a packer sealing actuating pressure to the interior (42) of the running tool (34). The packer latch device (38) is adapted to releasably engage a complementary running tool latch device (44) on the running tool (34) in order to releasably connect the packer assembly (32) with the running tool (34). Further, the packer latch device (38) is adapted to disengage from the running tool latch device (44) in order to disconnect the packer assembly (32) from the running tool (34) by the application of a latch actuating pressure to the interior (42) of the running tool (34).

Referring particularly to FIGS. 1, 2, 4, 5 and 7, the packer assembly (32) is comprised of a tubular packer body (46)

having a proximal end (48) and a distal end (50). The packer body (46) has an interior surface (52) defining a flow path or fluid passage therethrough between the proximal and distal ends (48, 50). The packer body (46) may be comprised of a single tubular member or it may be comprised of two or more tubular members interconnected together in any manner, either fixedly or releasably, to provide the packer body (46). In the preferred embodiment, the packer body (46) is comprised of a distal tubular section (54) defining the distal end (50) which is threadably engaged with a proximal tubular section (56) defining the proximal end (48).

The liner conduit (22) is connected with a downhole end of the packer assembly (32) in any manner and by any fixed or releasable connecting or fastening mechanism permitting the liner conduit (22) to extend from the packer assembly (32). Preferably, the liner conduit (22) is connected with the packer body (46) such that the packer body (46) and the liner conduit (22) define a continuous passage therethrough. In the preferred embodiment, the distal end (50) of the packer body (46) is fixedly connected, such as by welding, or threadably engaged with the perforated liner conduit (22) such that fluids may pass or flow between the adjacent ends of the packer body (46) and the liner conduit (22). Thus, fluids may be conducted between the packer body (46) and the liner conduit (22).

The packer sealing device (36) is carried by the packer body (46). In particular, the packer sealing device (36) is movably or slidably mounted about the packer body (46), preferably about the distal section (54) of the packer body (46) such that the distal end (50) of the packer body (46) extends downhole from the packer sealing device (36). The packer sealing device (36) has a proximal end (58) and a distal end (60). Thus, the distal end (50) of the packer body (46) extends downhole from the distal end (60) of the packer sealing device (36).

The packer sealing device (36) is comprised of an expandable sealing element (62), wherein the packer sealing device (36) is actuated to the expanded configuration by expanding the sealing element (62). The sealing element (62) may be comprised of any type or configuration of one or more sealing members or components which are capable of sealing the packer assembly (32) in the borehole (24). Preferably, the sealing element (62) is annular such that the sealing element (62) surrounds or extends about the packer sealing device (36) to seal substantially the entire annulus provided between the packer assembly (32) and the borehole (24) when the packer assembly (32) is positioned in the borehole (24).

In addition, as indicated, the sealing element (62) must be capable of being collapsed or retracted such that the packer sealing device (36) may be positioned in the borehole (24) in the collapsed configuration. Further, the sealing element (62) must be capable of being expanded such that the packer sealing device (36) may be actuated to the expanded configuration to engage the borehole (24). The sealing element (62) may be expanded in any manner. However, in the preferred embodiment, the sealing element (62) is expanded by compression of the sealing element (62). In particular, the sealing element (62) defines a sealing element axis (64). The sealing element (62) is preferably expanded by axially compressing the sealing element (62) or compressing the sealing element (62) in the direction of the sealing element axis (64).

The sealing element (62) is thus comprised of at least one annular, compressible seal member (66). However, in the preferred embodiment, the sealing element (62) is comprised of two annular, compressible seal members (66) separated by an annular spacer ring (68). Axial compression of the sealing element (62) causes each of the two seal members (66) to expand outwardly for sealing engagement with the borehole (24). Thus, each of the seal members (66) sealingly engages the borehole (24) in the expanded configuration. The presence of the spacer ring (68) therebetween facilitates or enhances the compression and expansion of the seal members (66). Greater than two seal members (66) may be utilized where necessary to achieve the desired sealing effect. However, in this case, a spacer ring (68) is preferably located between each of the seal members (66). The seal members (66) may be comprised of any suitable compressible material, but are preferably comprised of GV1200 high temperature seal material manufactured by A. R. Thomson group. The spacer ring (68) may be also be comprised of any suitable material, but is preferably comprised of steel.

In addition, the sealing element (62) is preferably bounded by, or contained between, a pair of yieldable extrusion rings (70). Thus, the seal members (66) and the spacer ring (68) are positioned or contained between the extrusion rings (70). The extrusion rings (70) are configured to overlap the adjacent ends or edges of the seal members (66) in order to maintain the seal members (66) in position. However, as the seal members (66) are axially compressed, the extrusion rings (70) yield to enable the seal members (66) to expand and the sealing element (62) to assume the expanded configuration. Thus, the extrusion rings (70) may be comprised of any yieldable material. However, in the preferred embodiment, the extrusion rings (70) are comprised of brass.

The sealing element (62) may be axially compressed by any mechanism or structure capable of causing such axial compression in response to the application of the packer sealing actuating pressure to the interior (42) of the running tool (34). However, preferably, the packer assembly (32) is further comprised of a movable setting sleeve (72) carried by the packer body (46). More particularly, the setting sleeve (72) is preferably axially movable relative to the packer body (46) in response to the application of the packer sealing actuating pressure.

The setting sleeve (72) has a proximal end (74), an opposed distal end (76) and an interior surface (78). The setting sleeve (72) may be comprised of a single tubular member or it may be comprised of two or more tubular members interconnected together in any manner, either fixedly or releasably, to provide the setting sleeve (72). In the preferred embodiment, the setting sleeve (72) is comprised of a distal sleeve section (80) defining the distal end (76) which is threadably engaged with a proximal sleeve section (82) defining the proximal end (74).

The setting sleeve (72) is movably or slidably mounted about the packer body (46) uphole of the proximal end (58) of the packer sealing device (36). Preferably, the distal end (76) of the setting sleeve (72) is adjacent the proximal end (58) of the packer sealing device (36) such that the setting sleeve (72) is capable of acting upon the sealing element (62). In other words, the distal end (76) of the setting sleeve (72) is provided to act upon and engage the proximal end (58) of the packer sealing device (36). More particularly, the setting sleeve (72) is axially movable relative to the packer body (46) in response to the application of the packer sealing actuating pressure. Axial movement of the setting sleeve (72) in the direction of the packer sealing device (36) results in the axial compression of the sealing element (62) by the setting sleeve (72), thereby expanding the sealing element (62) and actuating the packer sealing device (36) to the expanded configuration.

In addition, the packer sealing device (36) is preferably further comprised of a packer sealing restraining device (84) for restraining axial movement of the setting sleeve (72) relative to the packer body (46) before the application of the packer sealing actuating pressure. Thus, the packer sealing restraining device (84) is provided to prevent premature actuation of the setting sleeve (72) such that the packer sealing device (36) may be inserted in the borehole (24) to a desired position in the collapsed configuration.

The packer sealing restraining device (84) may be comprised of any suitable restraining mechanism or structure, such as a shearable fastener. Further, the packer sealing restraining device (84) may be located either uphole or downhole of the packer sealing device (36). In other words, the packer sealing restraining device (84) may be located to either side of the packing sealing device (36). However, preferably, the packer sealing restraining device (84) is located uphole of the proximal end (58) of the packer sealing device (36).

More preferably, the packer sealing restraining device (84) is comprised of at least one shearable fastener (86) for fastening the setting sleeve (72) to the packer body (46). The shearable fastener (86) or fasteners may be located at any position along the setting sleeve (72) between the setting sleeve (72) and the packer body (46). However, preferably, the shearable fastener (86) is located or positioned adjacent or in proximity to the distal end (76) of the setting sleeve (72). Thus, in particular, the shearable fastener (86) extends between the distal sleeve section (80) of the setting sleeve (72) and the adjacent distal section (54) of the packer body (46). The shearable fastener (86) is sheared upon application of the packer sealing actuating pressure to the interior (42) of the running tool (34) in order to permit the axial movement of the setting sleeve (72) relative to the packer body (46).

As well, the packer sealing device (36) is preferably capable of being maintained or locked in the expanded configuration. As a result, the packer assembly (32) is preferably further comprised of a packer locking mechanism (88) for locking the packer sealing device (36) in the expanded configuration. The packer locking mechanism (88) may be comprised of any suitable locking or retaining mechanism or structure. Further, the packer locking mechanism (88) may be located at any position along the length of the setting sleeve (72).

Preferably, the packer locking mechanism (88) is comprised of a ratchet mechanism (90) associated with the packer body (46) and the setting sleeve (72) for locking the position of the setting sleeve (72) relative to the packer body (46). The ratchet mechanism (90) may be located at any position along the setting sleeve (72) between the setting sleeve (72) and the packer body (46). However, preferably, the ratchet mechanism (90) is located or positioned adjacent or in proximity to the distal end (76) of the setting sleeve (72). Thus, in particular, the ratchet mechanism (90) acts between the distal sleeve section (80) of the setting sleeve (72) and the adjacent distal section (54) of the packer body (46).

Figure 20:
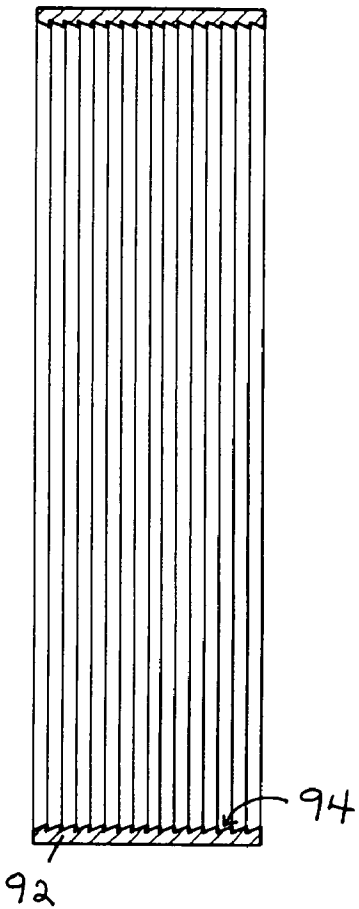
FIG. 20 is a cross-sectional view of a ratchet ring of a packer locking mechanism of the packer assembly shown in FIG. 1.
Figure 21:
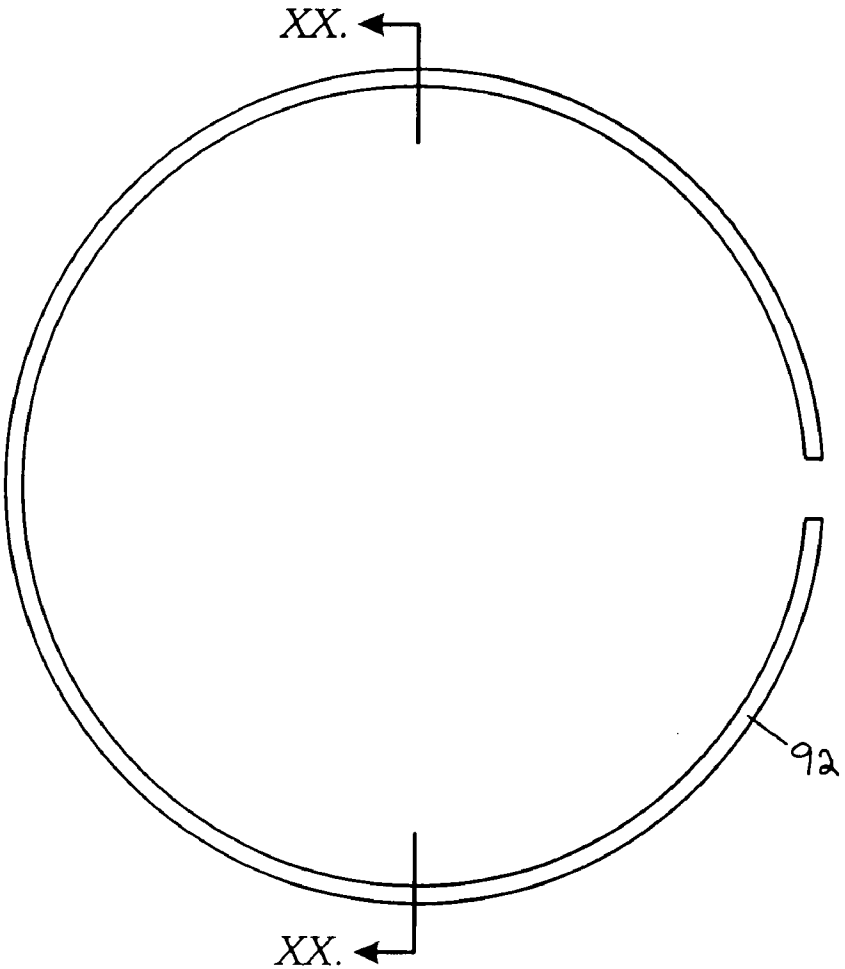
FIG. 21 is an end view of the ratchet ring shown in FIG. 20.

In the preferred embodiment, the ratchet mechanism (90) is comprised of a ratchet ring (92), as shown in FIGS. 20 and 21, held or fixed in position within the interior surface (78) of the distal sleeve section (80) of the setting sleeve (72). Further, the ratchet ring (92) is comprised of a plurality of inwardly facing ratchet teeth (94). The exterior surface of the packer body (46) adjacent the ratchet ring (92) also defines a plurality of ratchet teeth (96) which are compatible with the ratchet teeth (94) of the ratchet ring (92). Specifically, the ratchet teeth (94) of the ratchet ring (92) are adapted to engage the compatible ratchet teeth (96) of the packer body (46) in a manner permitting axial movement of the setting sleeve (72) relative to the packer body (46) in a downward or downhole direction, or in a direction towards the packer sealing device (36), only. Axial movement of the setting sleeve (72) relative to the packer body (46) in an opposed direction is prevented by the interlocking of the compatible ratchet teeth (94, 96).

As indicated above, the packer assembly (32) is also comprised of the packer latch device (38) which is adapted to releasably engage the complementary running tool latch device (44) on the running tool (34) in order to releasably connect the packer assembly (32) with the running tool (34). Specifically, the packer latch device (38) is adapted to disengage from the running tool latch device (44) in order to disconnect the packer assembly (32) from the running tool (34) by the application of the latch actuating pressure to the interior (42) of the running tool (34). Any complementary or compatible packer latch device (38) and running tool latch device (44) may be used to perform this function.

Figure 18A:
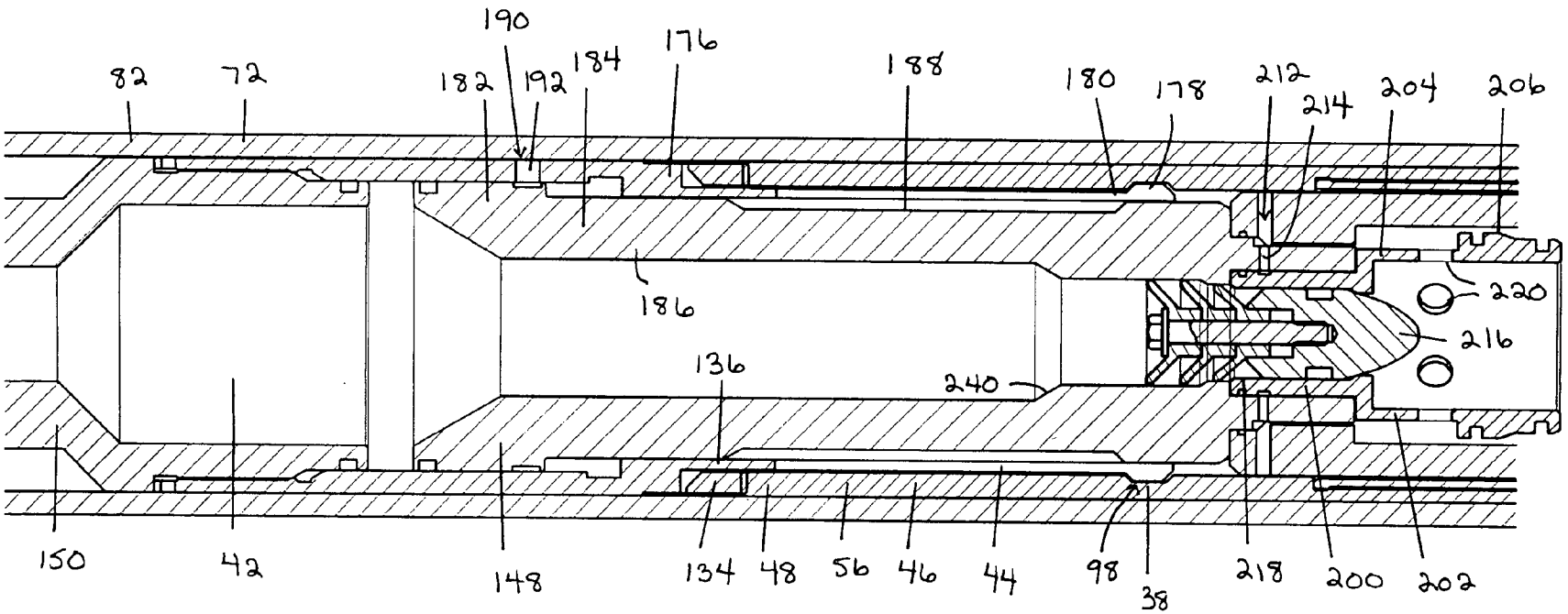
Figure 18B:
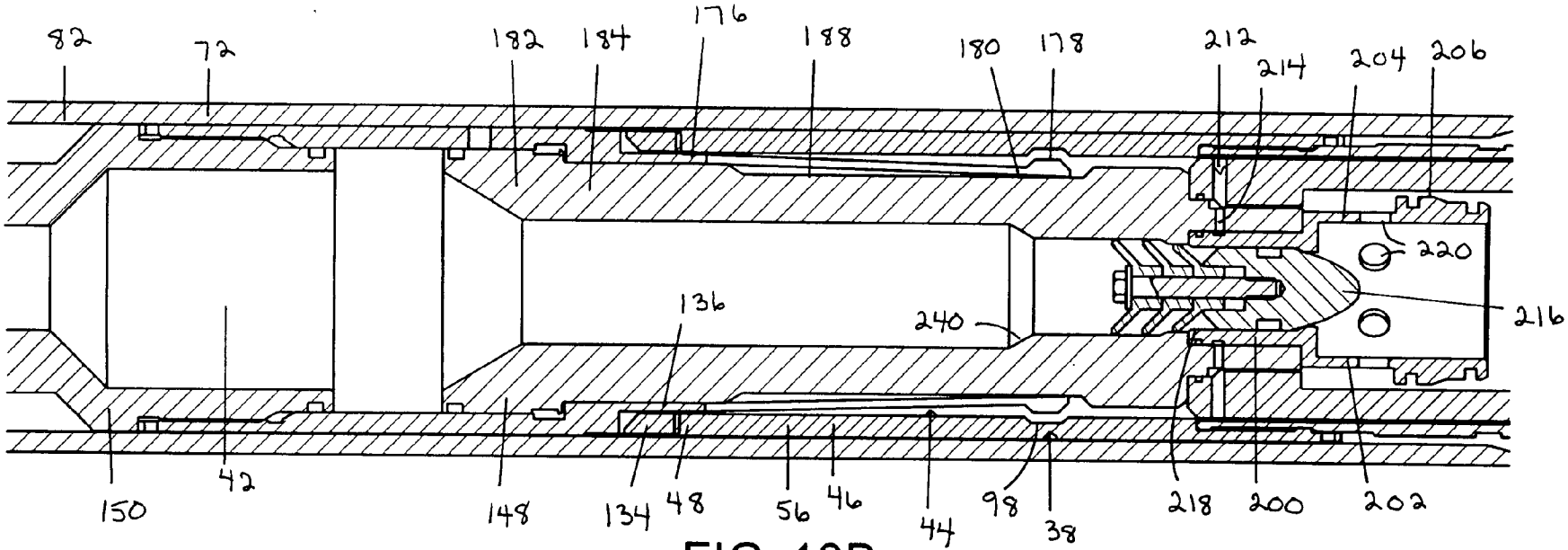
Figure 18C:
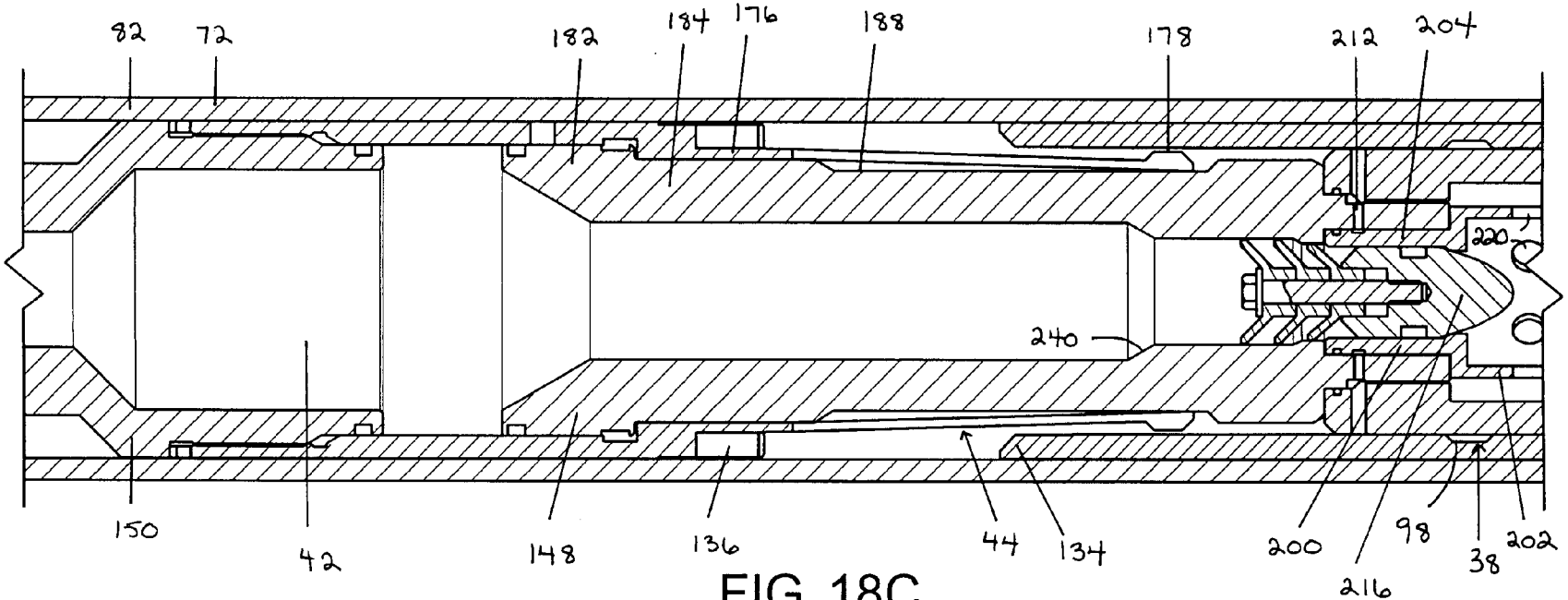
FIG. 18C shows the running tool latch device lifted relative to the packer latch device as in FIG. 12.
Figure 24:
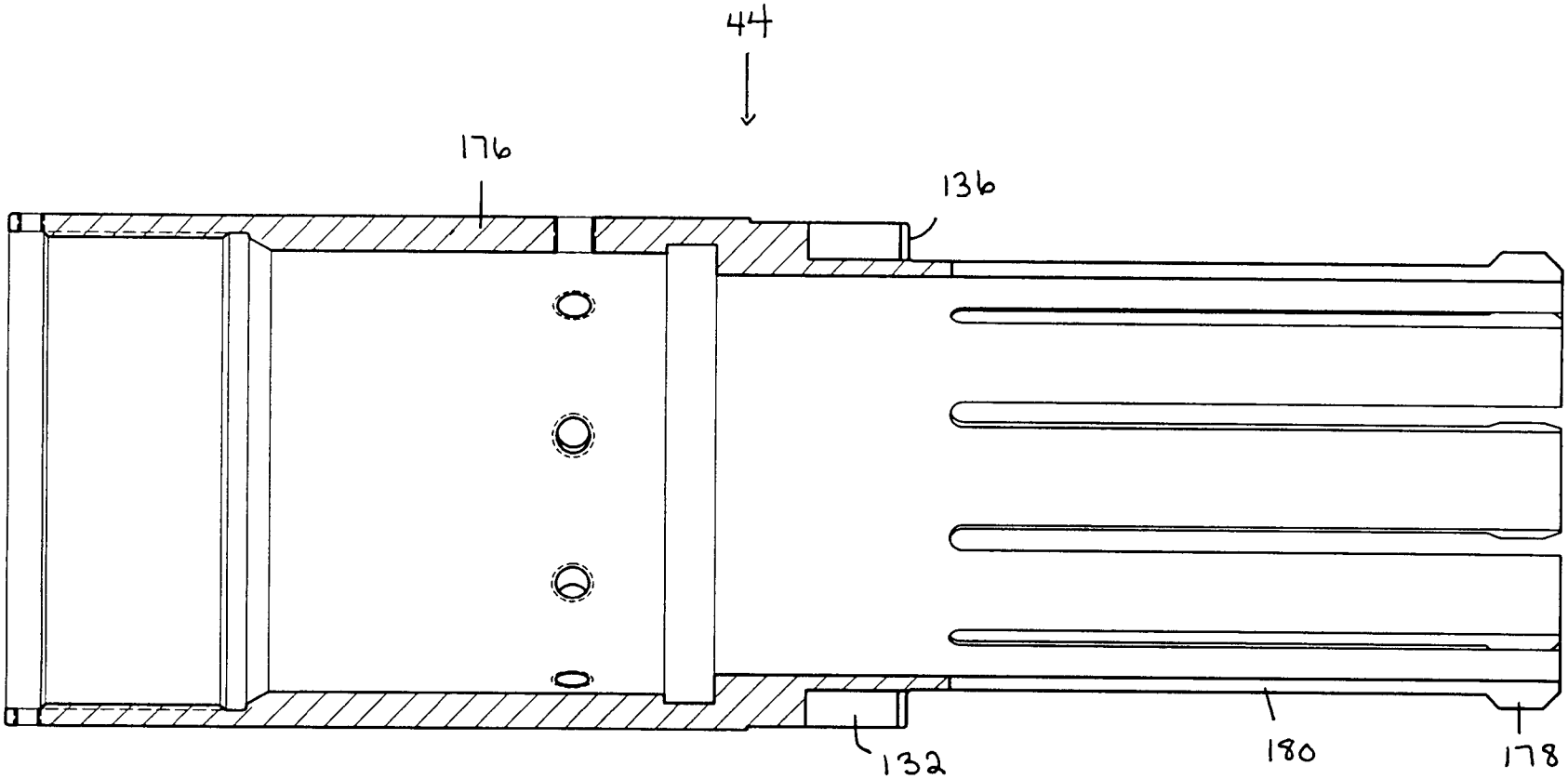
FIG. 24 is a cross-sectional view of a collet of the running tool latch device shown in FIG. 18.
Figure 25:
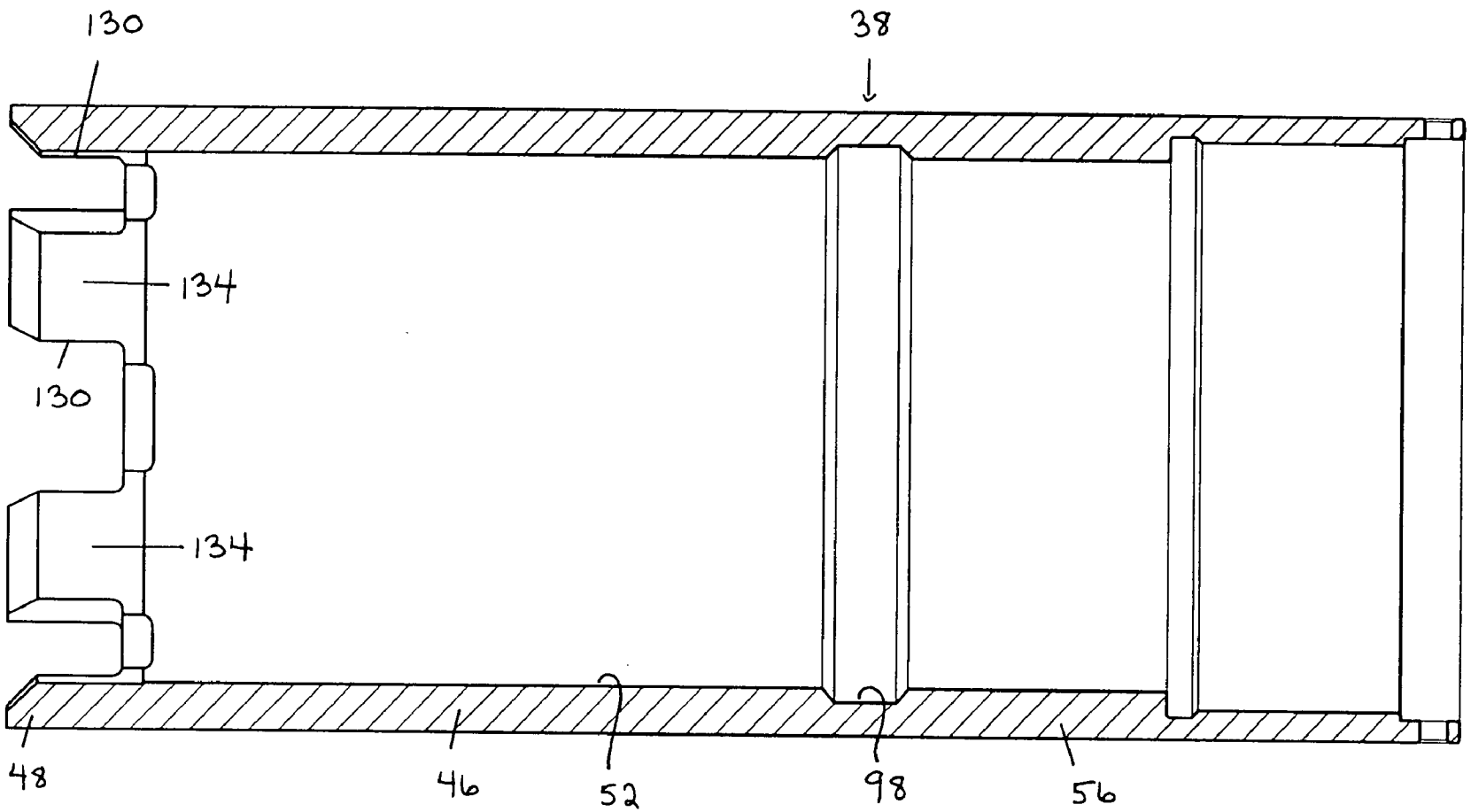
FIG. 25 is a cross-sectional view of a latch groove of the packer latch device shown in FIG. 18.

However, referring particularly to FIGS. 18, 24 and 25, in the preferred embodiment, the packer latch device (38) is comprised of a portion of the packer body (46) and is positioned between the packer body (46) and the adjacent structure of the running tool (34) comprising the complementary running tool latch device (44). More particularly, the interior surface (52) of the packer body (46) preferably defines a latch groove (98), wherein the packer latch device (38) is comprised of the latch groove (98). In the preferred embodiment, the interior surface (52) of the proximal section (56) of the packer body (46) defines the latch groove (98). The compatible or complementary running tool latch device (44) releasably engages the latch groove (98) as described in detail below.

In the preferred embodiment, the packer assembly (32) is further comprised of a packer bypass device (100) for bypassing a fluid from an exterior (102) of the packer assembly (32) to an interior (104) of the packer assembly (32). In some instances, depending upon the manner and extent of perforation of the liner conduit (22), the packer bypass device (100) may not be necessary. In these instances, the perforated liner conduit (22) may act as the packer bypass. For example, the perforated liner conduit (22) may act as a packer bypass where the liner conduit (22) is perforated up to the connection with the system (20). However, in these instances, the packer bypass will remain in an open position.

Figure 17A:
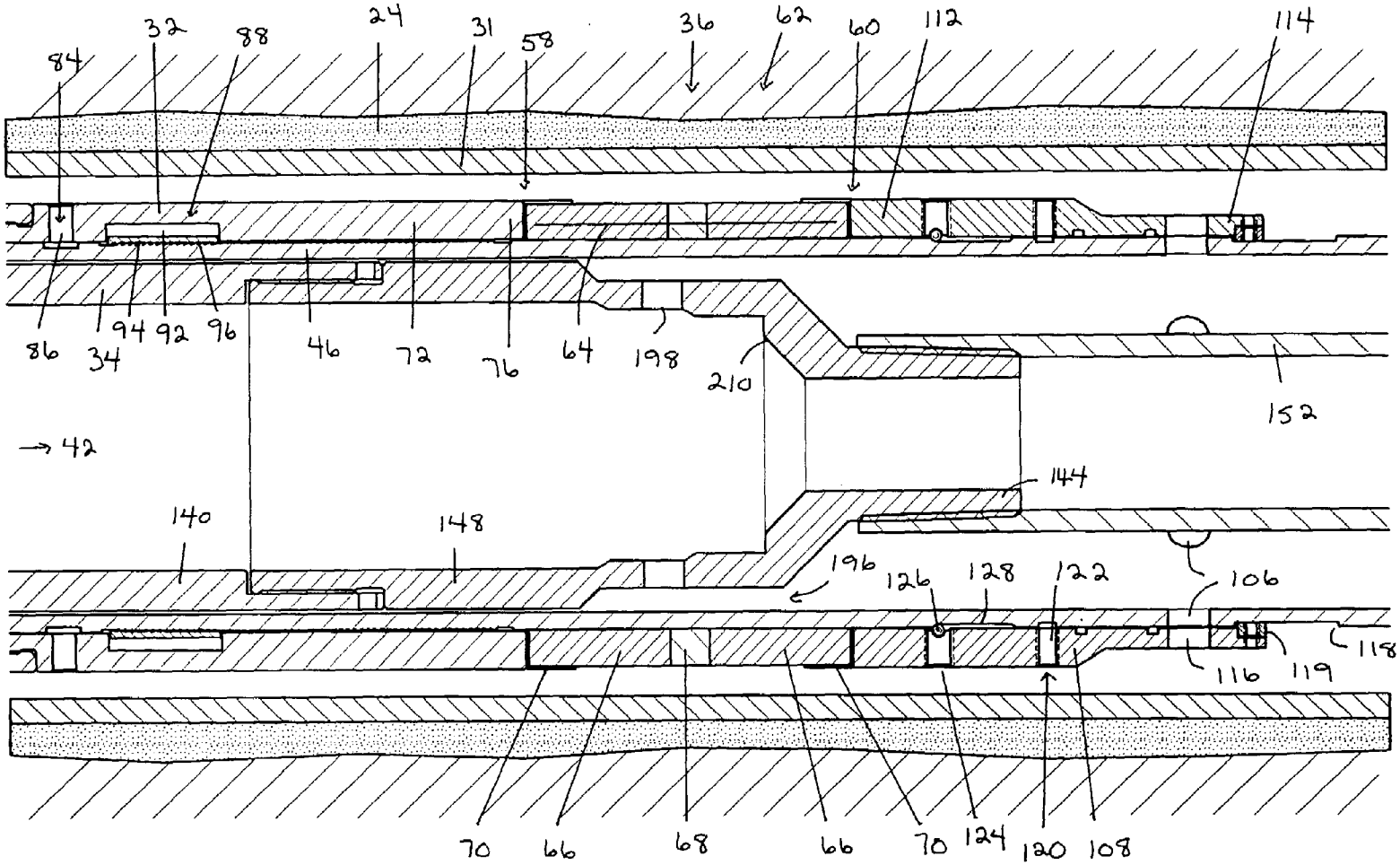
Figure 17B:
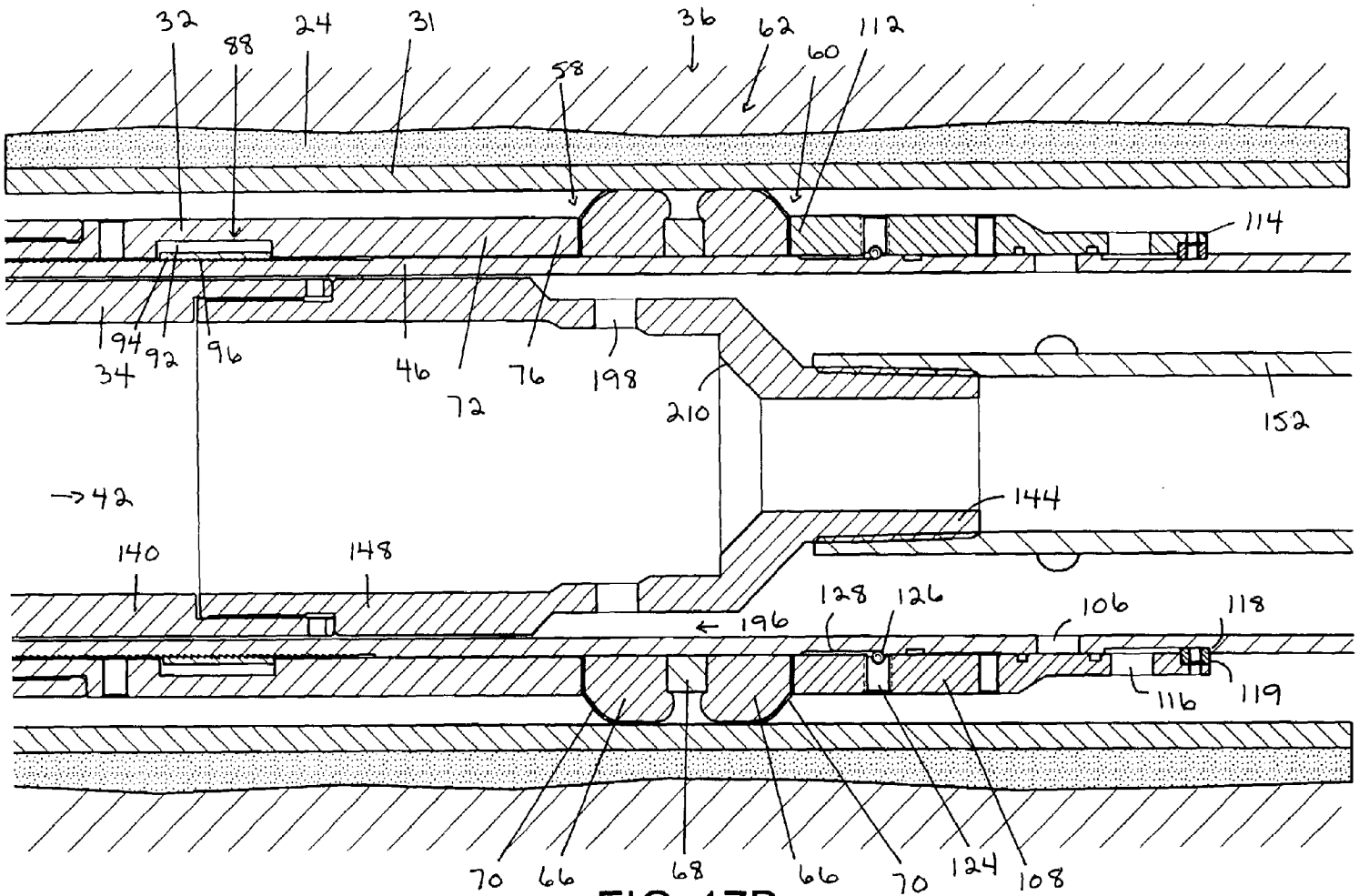
FIG. 17B shows the packer bypass device in a closed position as in FIG. 10.

Preferably, the packer bypass device (100) is adapted to be actuatable from an open position, as shown in FIG. 17A, to a closed position, as shown in FIG. 17B. Although the packer bypass device (100) may be actuated in any manner and by any mechanism, the packer bypass device (100) is preferably actuated hydraulically. In particular, the packer bypass device (100) is actuated by the application of fluid pressure to the running tool (34). In the preferred embodiment, the packer bypass device (100) is actuated by the application of a packer bypass actuating pressure to the interior (42) of the running tool (34).

However, in the preferred embodiment, the packer bypass actuating pressure and the packer sealing actuating pressure are comprised of a combined actuating pressure. As a result, the application of the combined actuating pressure actuates both the packer bypass device (100) and the packer sealing device (36).

The packer bypass device (100) may be comprised of any structure or mechanism capable of bypassing fluids from the exterior (102) to the interior (104) of the packer assembly (32). However, preferably, the packer bypass device (100) is comprised of a packer bypass port (106) and a complementary packer bypass valve (108). The packer bypass port (106) may be comprised of a single orifice defined by the packer body (46). Alternately, the packer bypass port (106) may be comprised of a plurality of orifices defined by the packer body (46) and collectively referred to as the packer bypass port (106). In particular, the distal section (54) of the packer body (46) preferably defines the packer bypass port (106).

The packer bypass valve (108) is preferably comprised of a structure or mechanism which is movable relative to the packer bypass port (106) to either open or close the packer bypass port (106) to permit or inhibit the passage of fluids therethrough respectively. In particular, the packer bypass valve (108) is comprised of a movable shutoff sleeve (110) carried by the packer body (46). The movable shutoff sleeve (110) is comprised of an annular or tubular member or element having a proximal end (112) and an opposed distal end (114) and which is positioned about the packer body (46) adjacent the packer bypass port (106). Preferably, the shutoff sleeve (110) defines one or more orifices (116) which are placed or positioned to be compatible with the orifices of the packer bypass port (106). In other words, the orifices (116) of the shutoff sleeve (110) may be aligned with the packer bypass port (106) in the open position of the packer bypass device (100) to permit fluid to pass between the exterior (102) and interior (104) of the packer bypass (32). Further, actuation of the packer bypass device (100) to the closed position moves the shutoff sleeve (110) relative to the packer body (46) such that the orifices (116) of the shutoff sleeve (110) are misaligned from, or moved out of alignment with, the packer bypass port (106) to inhibit or prevent the flow of fluids therethrough.

Preferably, the shutoff sleeve (110) is axially movable relative to the packer body (46) in response to the application of the packer bypass actuating pressure, and preferably the application of the combined actuating pressure, in order to actuate the packer bypass device (100) from the open position to the closed position. Further, the shutoff sleeve (110) and the setting sleeve (72) are preferably associated such that axial movement of the shutoff sleeve (110) is caused by axial movement of the setting sleeve (72). In particular, in the preferred embodiment, the packer bypass device (100) is located downhole of the setting sleeve (72). More particularly, the packer sealing device (36) is located between the distal end (76) of the setting sleeve (72) and the proximal end (112) of the shutoff sleeve (110). Thus, axial movement of the setting sleeve (72) may be transmitted to the shutoff sleeve (110) through the packer sealing device (36).

However, the length or extent of travel or axial movement of the shutoff sleeve (110) in a downward or downhole direction is limited by a stop shoulder (118) defined by the packer body (46) downhole of the shutoff sleeve (110). Further, the distal end (114) of the shutoff sleeve (110) is preferably comprised of a retainer ring (119). Therefore, the engagement or abutment of the retainer ring (119), comprising the distal end (114) of the shutoff sleeve (110), with the stop shoulder (118) prevents further axial movement of the shutoff sleeve (110) in a downwards direction. As a result, further axial movement of the setting sleeve (72) in the downward direction will axially compress the sealing element (62) of the packer sealing device (36). Thus, the sealing element (62) may be axially compressed between the shutoff sleeve (110) and the setting sleeve (72) in response to the application of the packer sealing actuating pressure, and preferably in response to the application of the combined actuating pressure.

In addition, the packer bypass device (100) is preferably further comprised of a packer bypass restraining device (120) for restraining axial movement of the shutoff sleeve (110) relative to the packer body (46) before the application of the packer bypass actuating pressure or the combined actuating pressure. Thus, the packer bypass restraining device (120) is provided to prevent premature actuation of the packer bypass device (100) to the closed position. The packer bypass restraining device (120) may be comprised of any suitable restraining mechanism or structure, such as a shearable fastener.

Further, given the association between the setting sleeve (72) and the shutoff sleeve (110) and given the preferred application of the combined actuating pressure, the packer bypass restraining device (120) may be comprised of the packer sealing restraining device (84) as described previously and conversely, the packer sealing restraining device (84) may be comprised of the packer bypass restraining device (120). In this case, as long as the packer assembly (32) is comprised of one of the packer sealing restraining device (84) and the packer bypass restraining device (120), the other of the packer sealing restraining device (84) and the packer bypass restraining device (120) may be omitted. In other words, one of the packer sealing restraining device (84) and the packer bypass restraining device (120) may be used to perform both functions, being the restraining of the axial movement of both the setting sleeve (72) and the shutoff sleeve (110). In this case, it is preferred that the packer sealing restraining device (84) be used to perform both functions and that the packer bypass restraining device (120) be treated as optional.

As indicated, the packer bypass restraining device (120) is preferably comprised of at least one shearable fastener (122) for fastening the shutoff sleeve (110) to the packer body (46). The shearable fastener (122) or fasteners may be located at any position along the shutoff sleeve (110) between the proximal and distal ends (112, 114) of the shutoff sleeve (110) which does not interfere with the orifices (116) or the packer bypass port (106). The shearable fastener (122) is sheared upon application of the packer bypass actuating pressure or the combined actuating pressure to the interior (42) of the running tool (34) in order to permit the axial movement of the shutoff sleeve (110) relative to the packer body (46).

In addition, referring to FIGS. 17A and 17B, in order to facilitate the axial movement or sliding of the shutoff sleeve (110) along the packer body (46), a bearing assembly (124) may be positioned between the adjacent surfaces of the shutoff sleeve (110) and the packer body (47). Although any suitable bearing assembly (124) may be used, the bearing assembly (124) is preferably comprised of one or more ball bearings (126) which are retained in position within the shutoff sleeve (110) by a fastener, such as a threaded bolt extending through the shutoff sleeve (110), and which are movable within a compatible groove (128) defined by the adjacent surface of the packer body (46). Thus, axial movement of the shutoff sleeve (110) causes each ball bearing (126) to move along or within the compatible groove (128) in the packer body (46).

Finally, it is preferable that a torque exerted on the running tool (34) be transferable to the packer assembly (32). Although any torque transmitting structure or mechanism may be used for this purpose, the packer assembly (32) is preferably further comprised of a packer torque transfer surface (130), as shown in FIG. 25, wherein the packer torque transfer surface (130) is adapted to engage with a complementary running tool torque transfer surface (132) so that a torque exerted on the running tool (34) may be transferred to the packer assembly (32).

The torque transfer surfaces (130, 132) may have any compatible structure or configuration. However, preferably, the packer torque transfer surface (130) is comprised of packer splines (134) which are adapted to engage complementary running tool splines (136) comprising the running tool torque transfer surface (132). Further, the packer splines (134) may be located at any position within, or may be comprised of any component of, the packer assembly (32). However, preferably, the packer splines (134) are associated with the packer body (46). In the preferred embodiment, the proximal end (48) of the packer body (46) is comprised of the packer splines (134) such that the packer splines (134) are readily or relatively easily accessed by the compatible running tool splines (136) as described further below. Specifically, when the running tool latch device (44) is engaged with the packer latch device (38) to releasably connect the packer assembly (32) with the running tool (34), the packer splines (134) are engaged with the compatible running tool splines (136) to permit the transfer of torque between the running tool (34) and the packer assembly (32).

Referring to FIGS. 1, 3, 4, 6, 7, 18, 19 and 22–25 of the running tool (34), the running tool (34) is preferably comprised of a packer sealing device actuator (138) adapted to actuate the packer sealing device (36) and the running tool latch device (44) for releasably engaging the packer latch device (38) in order to releasably connect the running tool (34) with the packer assembly (32). Although each of the packer sealing device actuator (138) and the running tool latch device (44) may be actuated in any manner and by any mechanism, each are preferably actuated hydraulically. In particular, each of the packer sealing device actuator (138) and the running tool latch device (44) are actuated by the application of fluid pressure to the running tool (34).

More particularly, the packer sealing device actuator (138) is adapted to actuate the packer sealing device (36) from the collapsed configuration to the expanded configuration in response to the application of the packer sealing actuating pressure to the interior (42) of the running tool (34). Further, the running tool latch device (44) is adapted to disengage from the packer assembly latch device (38) in order to disconnect the running tool (34) from the packer assembly (32) by the application of the latch actuating pressure to the interior (42) of the running tool (34).

Referring particularly to FIGS. 1, 3, 4, 6 and 7, the running tool (34) is comprised of a tubular running tool body (140) having a proximal end (144) and a distal end (146). The running tool body (140) has an interior surface (146) defining a flow path or fluid passage therethrough between the proximal and distal ends (142, 144). The running tool body (140) may be comprised of a single tubular member or it may be comprised of two or more tubular members interconnected together in any manner, either fixedly or releasably, to provide the running tool body (140). In the preferred embodiment, the running tool body (140) is comprised of a distal section (148) defining the distal end (144) which is slidably engaged with a proximal section (150) defining the proximal end (142), as described in detail below.

Further, the proximal end (142) of the running tool body (140) is adapted for connection with the working string (40) such that the running tool (34) is insertable in the borehole (24) using the working string (40). Further, a continuous flow path or a continuous passage for fluids is provided between the working string (40) and the interior (42) of the running tool (34), defined by the interior surface (146) of the running tool body (140), such that fluids may be conducted downhole to the running tool (34) through the working string (40). The working string (40) and the proximal end (142) of the running tool body (140) may be connected in any suitable manner, fixedly or releasably. However, preferably a threaded connection is provided therebetween.

In addition, the system (20) is preferably comprised of a circulating conduit (152) connected with the running tool (34). More particularly, the circulating conduit (152) is connected with a downhole end of the running tool (34) in any manner and by any fixed or releasable connecting or fastening mechanism permitting the circulating conduit (152) to extend from the running tool (34) within the liner conduit (22) connected with the packer assembly (32). Preferably, the circulating conduit (152) is connected with the running tool body (140) such that the running tool body (140) and the circulating conduit (152) define a continuous passage therethrough. In the preferred embodiment, the distal end (144) of the running tool body (140) is fixedly connected, such as by welding, or threadably engaged with the circulating conduit (152) such that fluids may pass or flow between the adjacent ends of the running tool body (140) and the circulating conduit (152).

The circulating conduit (152) is preferably provided to permit a circulating fluid or flushing fluid to be conducted through the liner conduit (22) after the liner conduit (22) is installed in the borehole (24) but before removal of the running tool (34). In other words, any undesirable fluids within the liner conduit (22), such as drilling fluids, may be flushed by the passing of the circulating fluid from the surface, through the circulating conduit (152) and back up the annulus between the circulating conduit (152) and the liner conduit (152). If the circulating conduit (152) were not present, in order to flush the liner conduit (22), a separate flushing tubing string would need to be run into the borehole in a separate trip following the installation of the liner conduit (22).

The packer sealing device actuator (138) may be comprised of any mechanism compatible with the packer sealing device (36) and capable of actuating the packer sealing device (36) from the collapsed to the expanded configurations in response to the packer sealing actuator pressure. Preferably, the packer sealing device actuator (138) is comprised of a movable actuating piston device (154) carried by the running tool body (140). More particularly, the actuating piston device (154) is preferably axially movable relative to the running tool body (140) in response to the application of the packer sealing actuating pressure.

In the preferred embodiment, the actuating piston device (154) is carried by and is axially movable relative to the proximal section (150) of the running tool body (140). Further, the actuating piston device (154) has a proximal end (156) and an opposed distal end (158) and is comprised of a plurality of members or components interconnected together to provide the actuating piston device (154). In particular, in the preferred embodiment, the actuating piston device (154) is comprised of a distal section (160), also referred to herein as a thrust ring, defining the distal end (158) of the actuating piston device (154), which distal section (160) is threadably connected with a proximal section (162) defining the proximal end (156) of the actuating piston device (154). The thrust ring (160) is shown in isolation in FIGS. 22 and 23.

The distal section or thrust ring (160) is provided for acting upon the packer assembly (32), and specifically for engaging the setting sleeve (72). Axial movement of the distal section (160) relative to the running tool body (140 in a downwards or downhole direction causes a corresponding movement of the setting sleeve (72) axially downwards or downhole to actuate the packer sealing device (36) to the expanded configuration. More particularly, the distal section or. thrust ring (160) of the actuating piston device (154) is comprised of a piston engagement surface (164) for engaging with the packer assembly (32) in order to actuate the packer sealing device (36) from the collapsed configuration to the expanded configuration.

Figure 23:
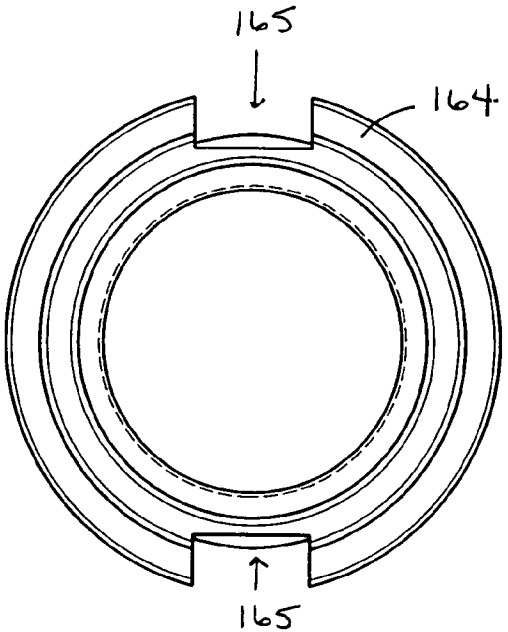
FIG. 23 is an end view of the thrust ring shown in FIG. 20.
Figure 22:
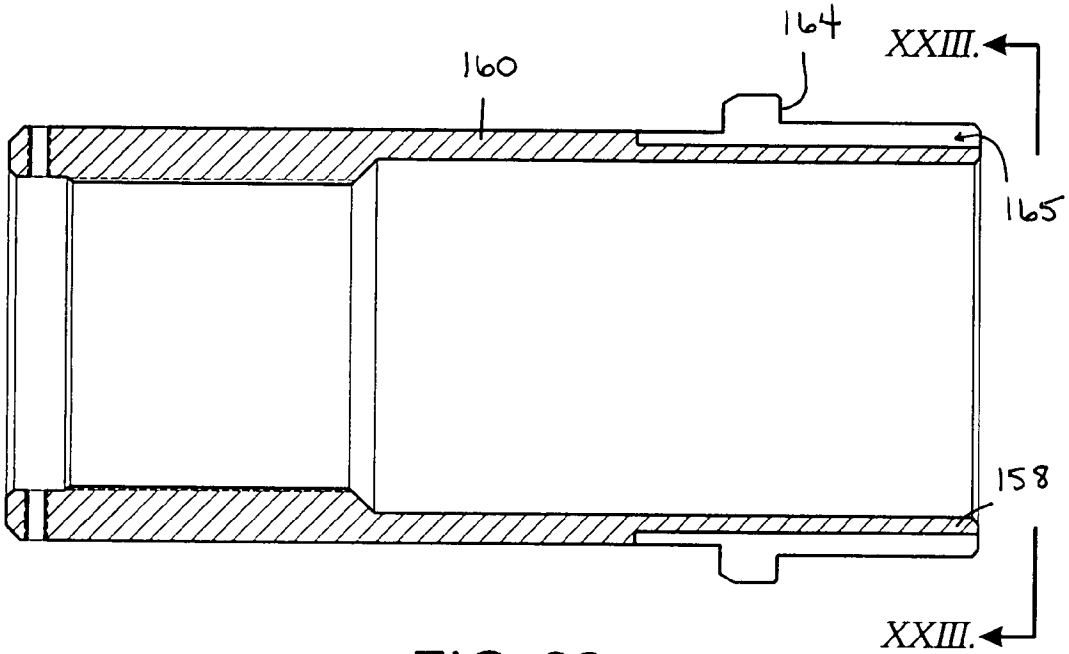
FIG. 22 is a cross-sectional view of a thrust ring of a setting sleeve of a packer sealing device actuator of the running tool shown in FIG. 1.

The piston engagement surface (164) preferably extends circumferentially about the thrust ring (160). In addition, as shown in FIGS. 22 and 23, the piston engagement surface (164) preferably extends substantially around the entire circumference of the thrust ring (160). However, in order to permit fluid flow past the piston engagement surface (164) from the annulus or space between the packer assembly (32) and the running tool (34), one or more grooves (165) may be defined therein. In the referred embodiment, two grooves (165) are provided which are spaced apart by about 180 degrees about the circumference of the thrust ring (160).

In the preferred embodiment, the piston engagement surface (164) engages the proximal end (74) of the setting sleeve (72). As a result, axial movement of the thrust ring (160) in a downwards or downhole direction towards the packer sealing device (36) results in a corresponding axial movement of the setting sleeve (72). Axial movement of the setting sleeve (72) in the direction of the packer sealing device (36) results in the axial compression of the sealing element (62) by the setting sleeve (72), thereby expanding the sealing element (62) and actuating the packer sealing device (36) to the expanded configuration.

The proximal section (162) of the actuating piston device (154) is acted upon by the packer sealing actuating pressure and thereby causes the distal section (160) to move axially to engage the setting sleeve (72). In particular, the running tool body (140) and the actuating piston device (154) define a piston chamber (166) therebetween. Further, the piston chamber (166) is defined between an upper piston member (168) and a lower piston member (170). The upper piston member (166) is fixedly mounted or connected with the running tool body (140), particularly the proximal section (150) of the running tool body (140), and is contained within the proximal section (162) of the actuating piston device (154). The lower piston member (170) is comprised of the proximal section (162) of the actuating piston device (154) and is movable in a direction away from the upper piston member (168) as the packer sealing actuating pressure is communicated to the piston chamber (166). Finally, the running tool body (140) defines a piston chamber port (172) extending between the interior (42) of the running tool (34) and the piston chamber (166) for communicating the packer sealing actuating pressure to the piston chamber (166).

In addition, where the packer assembly (32) is comprised of the packer bypass device (100), the running tool (34) is preferably further comprised of a packer bypass device actuator (174) adapted to actuate the packer bypass device (100) from the open position to the closed position in response to the application of the packer bypass actuating pressure to the interior (42) of the running tool (34). In the preferred embodiment, the packer bypass device actuator (174) is comprised of the packer sealing device actuator (138). In other words, the same structure is utilized to actuate both the packer sealing device (36) and the packer bypass device (100). Thus, the same structure is provided to axially move the setting sleeve (72) which actuates both the packer sealing device (36) and the packer bypass device (100). However, a different and/or separate structure or mechanism may be provided for each of the packer bypass device actuator (174) and the packer sealing device actuator (138) where desired.

Thus, in the preferred embodiment, the packer bypass device actuator (174) is comprised of the movable actuating piston device (154) carried by the running tool body (140), as described in detail above. Thus, the actuating piston device (154) is axially movable relative to the running tool body (140) in response to the application of the packer bypass actuating pressure. Further, the piston chamber port (172) extends between the interior (42) of the running tool (34) and the piston chamber (166) for communicating the packer bypass actuating pressure to the piston chamber (166). In addition, the actuating piston device (154) is comprised of the piston engagement surface (164) for engaging with the packer assembly (32) in order to actuate the packer bypass device (100) from the open position to the closed position.

Thus, in summary, both the packer sealing device actuator (138) and the packer bypass device actuator (174) are comprised of the actuating piston device (154). Accordingly, actuation of the actuating piston device (154) acts upon the setting sleeve (72) to actuate both the packer sealing device (36) and the packer bypass device (100). The packer bypass actuating pressure and the packer sealing actuating pressure may be different pressures. However, in the preferred embodiment, as discussed above, the packer bypass actuating pressure and the packer sealing actuating pressure are comprised of a combined actuating pressure such that the application of the combined actuating pressure actuates both the packer bypass device (100) to the closed position and the packer sealing device (36) to the expanded configuration.

As indicated above, the running tool (34) is comprised of the running tool latch device (44). The running tool latch device (44) may be comprised of any structure or mechanism compatible with the packer latch device (38) such that the packer latch device (38) may releasably engage the running tool latch device (44) in order to releasably connect the packer assembly (32) with the running tool (34). Specifically, the packer latch device (38) is adapted to disengage from the running tool latch device (44) upon the application of the latch actuating pressure to the interior (42) of the running tool (34).

Referring particularly to FIGS.

the preferred embodiment, the packer latch device (38) is comprised of the latch groove (98). Thus, the running tool latch device (44) may be comprised of any compatible or complementary structure or mechanism capable of releasably engaging the latch groove (98). However, the running tool latch device (44) is preferably comprised of a collet (176) which is adapted to engage the latch groove (98). Specifically, the collet (176) is comprised of collet engagement surface (178) which is receivable within the latch groove (98) to engage the collet (176) with the latch groove (98). Thus, the collet (176) is preferably positioned along the length of the running tool body (140) at a location permitting the collet engagement surface (178) to be received by the latch groove (98). In the preferred embodiment, the proximal section (150) of the running tool body (140) comprises the collet (176).

Specifically, as indicated above, in the preferred embodiment, the running tool body (140) is comprised of the distal section (148) which is slidably engaged with the proximal section (150). In particular, the distal section (148) of the running tool body (140) is slidably received within a distal end (180) of the proximal section (150) of the running tool body (140). Preferably, the distal end (180) of the proximal section (150) of the running tool body (140) is comprised of the collet (176) such that the collet engagement surface (178) extends towards the distal end (144) of the running tool body (140).

Preferably, the running tool (34) is further comprised of a latch device actuator (182) adapted to disengage the running tool latch device (44) from the packer assembly latch device (38) in response to the application of the latch actuating pressure to the interior (42) of the running tool (34). The latch device actuator (182) may be comprised of any structure or mechanism capable of disengaging the running tool latch device (44) from the packer assembly latch device (38). However, preferably, the latch device actuator (182) is comprised of a movable latch actuating member (184).

The latch actuating member (184) is preferably carried by the running tool body (140). In particular, the latch actuating member (184) either comprises the running tool body (140) or is connected, fixedly or releasably, with the running tool body (140). For instance, the latch actuating member (184) may be comprised of an end of the distal section (148) of the running tool body (140) which is slidably received within the distal end (180) of the proximal section (150) of the running tool body (140). Alternately, the latch actuating member (184) may be connected with the end of the distal section (148) of the running tool body (140) such that the latch actuating member (184) is slidably received within the distal end (180) of the proximal section (150) of the running tool body (140). In either case, the latch actuating member (184) is contained, at least in part, within the proximal section (150) of the running tool body (140). More particularly, the latch actuating member (184) is contained, at least in part, within the collet (176).

The latch actuating member (184) may be actuated in any manner by the latch actuating pressure. However, preferably, the latch actuating member (184) is comprised of a latch releasing piston (186) which is axially movable relative to the running tool body (140), and particularly relative to the collet (176), in response to the application of the latch actuating pressure in order to disengage the collet (176) from the latch groove (98). Specifically, the latch releasing piston (186) has an outer surface defining a collet retaining groove (188) therein. As a result, axial movement of the latch releasing piston (186) in response to the latch actuating pressure causes the collet (176), and particularly the collet engagement surface (178), to enter the collet retaining groove (188). Movement of the collet engagement surface (178) into the collet retaining groove (188) allows the collet engagement surface (178) to disengage from the latch groove (98). As a result, the running tool (34) may be removed from the packer assembly (32).

In addition, the latch device actuator (182) is preferably further comprised of a latch actuating restraining device (190) for restraining axial movement of the latch releasing piston (186) relative to the running tool body (140), and particularly the collet (176), before the application of the latch actuating pressure. Thus, the latch actuating restraining device (190) is provided to prevent premature actuation of the latch releasing piston (186) to disengage the running tool (34) from the packer assembly (32). The latch actuating restraining device (190) may be comprised of any suitable restraining mechanism or structure, such as a shearable fastener (192). Further, the latch actuating restraining device (190) may be located at any position between the collet (176) and the latch releasing piston (186). Thus, the shearable fastener (192) is sheared upon application of the latch actuating pressure to the interior (42) of the running tool (34), which acts upon the latch releasing piston (186), in order to permit the axial movement of the latch releasing piston (186) relative to the collet (176).

Figure 11:
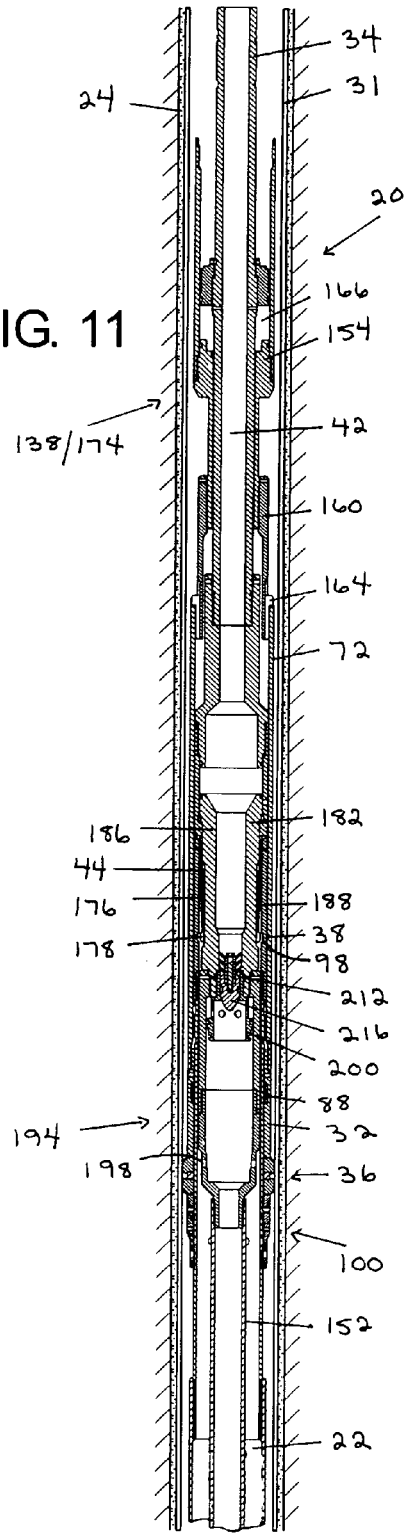
Figure 19A:
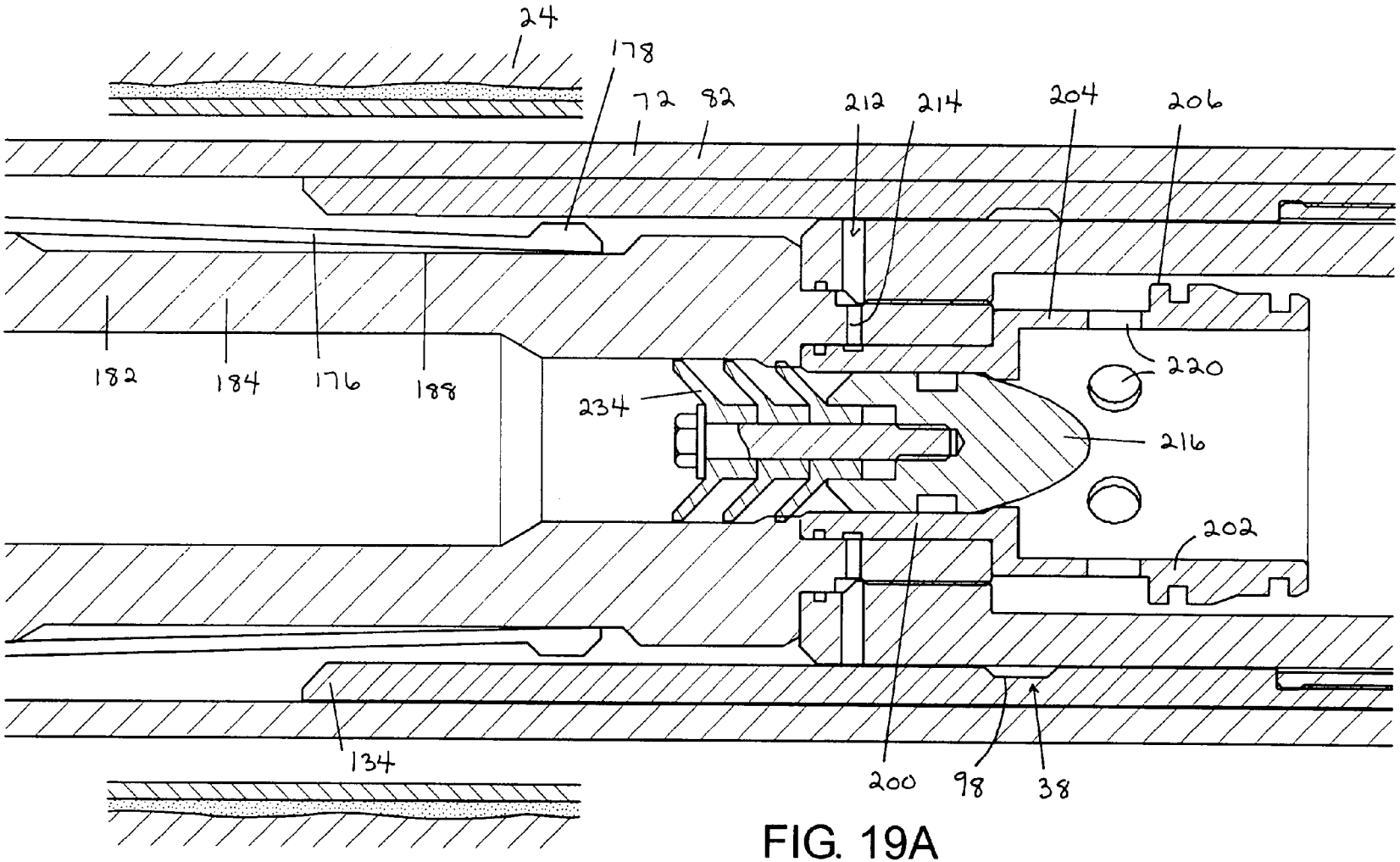
Figure 19B:
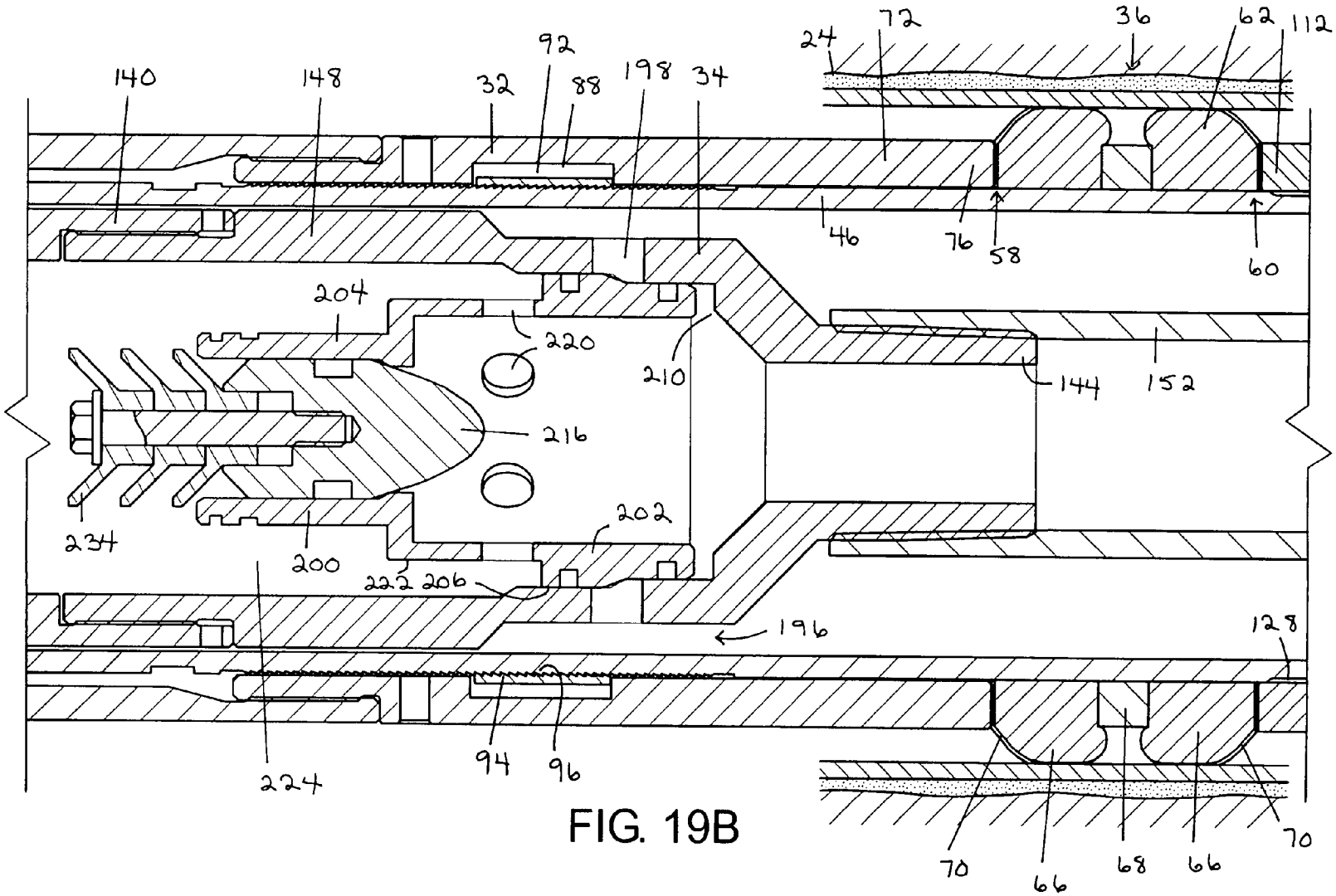
FIG. 19B shows the running tool bypass device in a closed position as in FIG. 11.

In the preferred embodiment, the running tool (34) is further comprised of a running tool bypass device (194) for bypassing a fluid from an exterior (196) of the running tool (34) to the interior (42) of the running tool (34). Preferably, the running tool bypass device (194) is adapted to be actuatable from an open position, as shown in FIGS. 10 and 19A, to a closed position, as shown in FIGS. 11 and 19B. Although the running tool bypass device (194) may be actuated in any manner and by any mechanism, the running tool bypass device (194) is preferably actuated hydraulically. In particular, the running tool bypass device (194) is actuated by the application of fluid pressure to the running tool (34). In the preferred embodiment, the running tool bypass device (194) is actuated by the application of a running tool bypass actuating pressure to the interior (42) of the running tool (34).

The running tool bypass device (194) may be comprised of any structure or mechanism capable of bypassing fluids from the exterior (196) to the interior (42) of the running tool (34). However, preferably, the running tool bypass device (194) is comprised of a running tool bypass port (198) and a complementary running tool bypass valve (200). The running tool bypass port (198) may be comprised of a single orifice defined by the running tool body (140). Alternately, the running tool bypass port (198) may be comprised of a plurality of orifices defined by the running tool body (140) and collectively referred to as the running tool bypass port (198). In particular, the distal section (148) of the running tool body (140) preferably defines the running tool bypass port (198). In the preferred embodiment, the distal section (148) of the running tool body (140) adjacent the distal end (144) defines the running tool bypass port (198).

The running tool bypass valve (200) is preferably comprised of a structure or mechanism which is movable relative to the running tool bypass port (198) to either open or close the running tool bypass port (198) to permit or inhibit the passage of fluids therethrough respectively. In particular, the running tool bypass valve (200) is comprised of a movable shutoff member (202) carried by the running tool body (140). In the preferred embodiment, the movable shutoff member (202) is comprised of a shutoff piston (204) contained within the running tool body (140) which is axially movable relative to the running tool body (140) in response to the application of the running tool bypass actuating pressure in order to close the running tool bypass port (198). More particularly, the shutoff piston (204) is carried by and axially movable within the distal section (148) of the running tool body (140) adjacent the distal end (144).

Further, the running tool bypass valve (200), and particularly the shutoff piston (204), is preferably comprised of a tubular member having an outer circumferential surface (206) and defining a bypass valve flowbore (208) extending therethrough. The outer surface (206) of the shutoff piston (204) is closely received within the interior (42) of the distal section (148) of the running tool body (140) in a manner permitting its axial movement therein. In the open position of the running tool bypass device (194), the shutoff piston (204) is positioned out of alignment with the running tool bypass port (198) to permit fluid to pass through the running tool bypass port (198) from the exterior (196) of the running tool (34) into the interior (42).

From the open position, the shutoff piston (204) is axially moved towards the closed position in the direction of the distal end (144) of the running tool body (140) in response to the running tool bypass actuating pressure. In this regard, the interior surface (42) of the running tool body (140) defines a valve seat (210) at the distal end (144) thereof for engaging the running tool bypass valve (200) in the closed position. Thus, in the closed position of the running tool bypass device (194), the shutoff piston (204) engages the valve seat (210) such that the shutoff piston (204) is positioned adjacent the running tool bypass port (198). Further, the outer surface (206) of the shutoff piston (204) sealingly engages the interior (42) of the running tool body (140) about the running tool bypass port (198) in order to close the running tool bypass port (198).

In addition, the running tool bypass device (194) is preferably further comprised of a running tool bypass restraining device (212) for restraining axial movement of the shutoff piston (204) relative to the running tool body (140), and particularly the distal section (148), before the application of the running tool bypass actuating pressure. Thus, the running tool bypass restraining device (212) is provided to prevent premature actuation of the running tool bypass device (194) to the closed position. The running tool bypass restraining device (212) may be comprised of any suitable restraining mechanism or structure, such as a shearable fastener (214). Further, the running tool bypass restraining device (212) may be located at any position between the distal section (148) of the running tool body (140) and the shutoff piston (204). Thus, the shearable fastener (214) is sheared upon application of the running tool bypass actuating pressure to the interior (42) of the running tool (34), which acts upon the shutoff piston (204), in order to permit the axial movement of the shutoff piston (204) relative to the running tool body (140).

As described herein, various actuating pressures are required to be applied to the interior (42) of the running tool (34) in order to actuate the various components of the packer assembly (32) and the running tool (34). In order to facilitate the application of the various actuating pressures by the creation of a back pressure in the interior (42) of the running tool (34), a setting plug (216) may be used. Specifically, the setting plug (216) may be passed through the interior (42) of the running tool (34) in order to obstruct the interior (42). In this case, the interior (42) of the running tool (34) is comprised of a setting plug landing surface (218) adapted to accept the setting plug (216) in order to obstruct the interior (42) of the running tool (34).

The setting plug landing surface (218) is preferably located at, adjacent or in proximity to the distal end (144) of the running tool body (140) to permit the creation of the actuating pressures through the running tool (34). In the preferred embodiment, the setting plug landing surface (218) is associated with the running tool bypass valve (200). In particular, the setting plug landing surface (218) is associated with the bypass valve flowbore (208) so that the setting plug (216) will obstruct the bypass valve flowbore (208).

Further, it is desirable that when the running tool bypass device (194) is in the open position that the interior (42) of the running tool (34) be significantly or substantially obstructed by the setting plug (216). However, it is further desirable that the obstruction be lessened or eliminated when the running tool bypass device (194) is actuated to the closed position. Specifically, following the actuation of the running tool bypass device (194) to the closed position, it may be desirable to conduct a circulating fluid into the circulating conduit (152) through the running tool (34).

As a result, the running tool bypass valve (200) preferably defines a circulating port (220) extending from an exterior (222) of the running tool bypass valve (200) to the bypass valve flowbore (208). Further, the running tool bypass device (194) is further comprised of a bypass chamber (224) which is configured so that a circulating fluid may be passed through the circulating port (220) when the setting plug (216) is landed in the setting plug landing surface (218) and the running tool bypass device (194) is in the closed position.

The circulating port (220) may be comprised of a single orifice defined by the running tool bypass valve (200). Alternately, the circulating port (220) may be comprised of a plurality of orifices defined by the running tool bypass valve (200) and collectively referred to as the circulating port (220). The bypass chamber (224) is preferably comprised of a portion of the distal section (148) of the running tool body (140) which defines an area within the interior (42) of sufficient size and dimension to permit the passage of fluid between the interior (42) of the running tool (34) and the circulating port (220). In other words, the bypass chamber (224) is configured to provide a sufficient annulus between the outer surface (206) of the shutoff piston (204) and the interior (42) of the running tool (42) to permit relatively unobstructed flow of the circulating fluid to and from the circulating port (220).

Finally, as noted above, it is preferable that a torque exerted on the running tool (34) be transferable to the packer assembly (32). Thus, the running tool (34) is further comprised of the running tool torque transfer surface (132) which is adapted to engage with the complementary packer assembly torque transfer surface (130) as described above. Although the torque transfer surfaces (130, 132) may have any compatible structure or configuration, the packer torque transfer surface (130) is comprised of the packer splines (134) which are adapted to engage the complementary running tool splines (136) comprising the running tool torque transfer surface (132).

The running tool splines (136) may be located at any position within, or may be comprised of any component of, the running tool (34). However, preferably, the running tool splines (136) are preferably associated with the running tool body (140) and may be located at any position along the length of the running tool body (140) compatible with engaging the packer splines (134). In the preferred embodiment, the proximal section (150) of the running tool body (140) is comprised of the running tool splines (136), preferably adjacent or in proximity to the distal end (180) thereof, such that the running tool splines (136) are readily or relatively easily accessed by the compatible packer splines (134).

Figure 15:
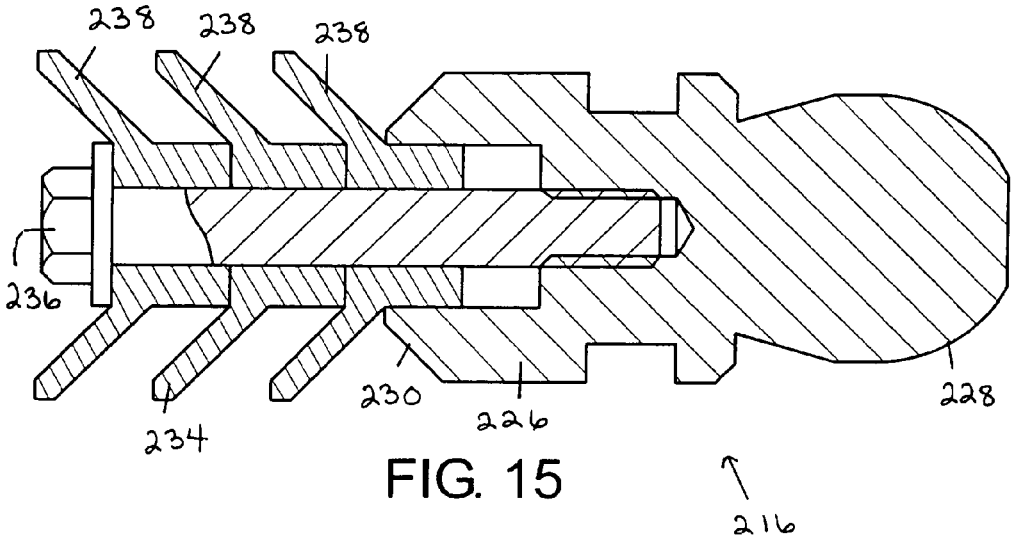
FIG. 15 is a first embodiment of a setting plug used in performance of the method.
Figure 16:
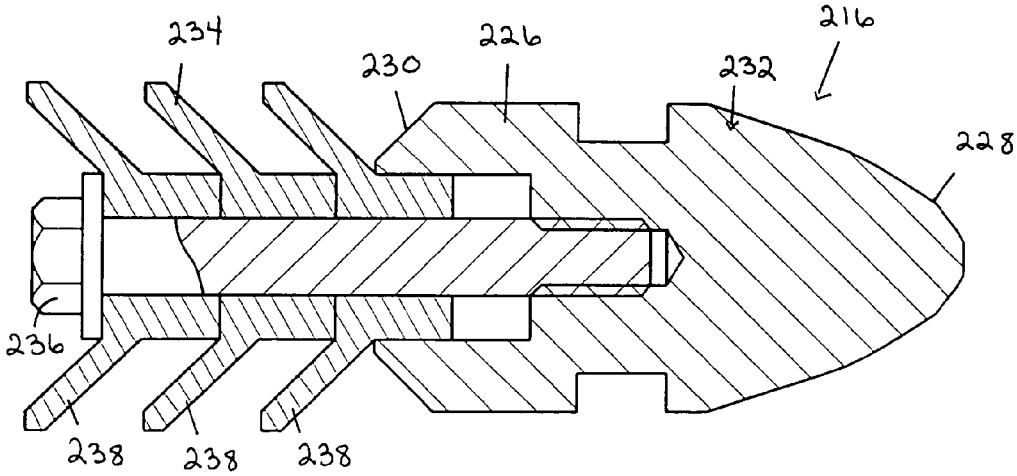
FIG. 16 is a second embodiment of the setting plug used performance of the method.

The setting plug (216) used herein may be comprised of any suitable plugging structure or mechanism receivable within the setting plug landing surface (218) and capable of obstructing the interior (42) of the running tool (34). However, two embodiments of the setting plug (216) which may be utilized are shown in FIGS. 15 and 16. In both embodiments, the setting plug (216) is comprised of a plug body (226) adapted for passage through the working string (40) and the running tool (34). The plug body (226) has a head portion (228) and an opposed tail portion (230). The head portion (228) is configured to be accepted by and sealingly receivable within the setting plug landing surface (218).

FIG. 15 shows a first embodiment of the setting plug (216) which is constructed entirely of steel and which is intended for use where the setting plug (216) is relatively small in diameter. FIG. 16 shows a second embodiment of the setting plug (216) which is constructed primarily of aluminum to decrease the weight of the setting plug (216) and which is intended for use where the setting plug (216) is relatively large in diameter. However, due to the relatively deformable nature of the aluminum in the second embodiment, the head portion (228) preferably includes a steel ring (232) for resisting any deformation of the setting plug (216) which may occur as the setting plug (216) is passed through the working string (40).

In addition, in both embodiments, the setting plug (216) is preferably comprised of a resilient fin section (234) which is attached to or affixed with the tail portion (230) of the plug body (226), preferably by a bolt (236) extending through the fin section (234) and within the plug body (226). The fin section (234) is provided to permit the setting plug (216) to be pumped through the working string (40) to the running tool (34). Specifically, the fluid acts upon the fin section (234) to propel the setting plug (216) therethrough. Preferably, the fin section (234) is comprised of at least one rubber cone (238), and preferably a plurality of rubber cones (238) arranged end to end. The rubber cones (238) preferably have a diameter greater than the setting plug (216) in order to provide a seal to assist in pushing or pumping the setting plug (216) through the working string (40).

Finally, the configuration and size of the bypass chamber (224) of the running tool bypass device (194) discussed previously must be selected taking into account the size of the rubber cones (238) of the setting plug (216). Specifically, when the setting plug (216) is received in the setting plug landing surface (218), the rubber cones (238) must not significantly or substantially block the bypass chamber (224) or the flow of the circulating fluid therethrough. If the bypass chamber (224) is obstructed, a different configuration of setting plug (216) may be required to be used, such as a ball or plugging structure without the fin section (234).

If for any reason the running tool bypass device (194) is accidentally or inadvertently actuated to the closed position earlier than desired, such as prior to the actuation of the packer sealing device (36), the interior (42) of the running tool (34) may not be obstructed sufficiently to permit the application of the desired actuating pressures, such as the packer sealing actuating pressure. In this case, additional setting plugs (216) may be passed into the interior (42) of the running tool body (140). As a result, the interior or bore of the latch releasing piston (186) preferably defines one or more constrictions (240) therein to provide at least one alternate setting plug landing surface. However, in the event that an alternate setting plug is utilized, a circulating fluid will not be able to be subsequently conducted to the circulating conduit (152) through the running tool (34).

The within invention is further comprised of a method for installing the liner conduit (22) and the packer assembly (32) in the borehole (24). In addition, the method preferably concurrently temporarily inserts the circulating conduit (152) in the borehole (24) to permit the flushing of the liner conduit (22) following its installation. Any suitable apparatus, mechanism, device or system may be used which is capable of performing each of the method steps described herein. However, in the preferred embodiment, the method is performed using the preferred embodiment of the system (20) described herein. Further, the preferred embodiment of the method is shown in sequence in FIGS. 8 through 14.

Referring to FIG. 8, the method for installing the liner conduit (22) in the borehole (24) is comprised of the step of inserting the system (20) comprising the liner conduit (22), the packer assembly (32) and the running tool (34) in the borehole (24), wherein the liner conduit (22) is connected with the packer assembly (32) and the packer assembly (32) is releasably connected with the running tool (34). Preferably, the system (20) is connected with the working string (40) which is used to insert the system (20) in the borehole (24) from the surface, and later is used to remove the running tool (34) once the packer assembly (32) is set downhole. Thus, the working string (40) is preferably connected with the running tool (34).

As indicated above, the preferred embodiment of the system (20), packer assembly (32) and running tool (34) are preferably used in the performance of the method. Thus, for instance, the packer assembly (32) is comprised of the packer sealing device (36) and the packer latch device (38) and the running tool (34) is comprised of the a packer sealing device actuator (138) and the running tool latch device (44), all as described above. In addition, the packer assembly (32) is preferably comprised of the packer bypass device (100) for bypassing fluids from the exterior (102) of the packer assembly (32) to the interior (104) of the packer assembly (32). As well, the running tool (34) is preferably further comprised of the running tool bypass device (194) for bypassing fluids from the exterior (196) of the running tool (34) to the interior (42) of the running tool (34).

In addition, the circulating conduit (152) is also preferably connected with the running tool (34). Thus, the inserting step is preferably comprised of concurrently inserting the liner conduit (22), the packer assembly (32), the running tool (34) and the circulating conduit (152) in the borehole (24). Specifically, the liner conduit (22) is connected with the packer assembly (32), the circulating conduit (152) is connected with the running tool (34) and extends within the liner conduit (22) and the packer assembly (32) is releasably connected with the running tool (34).

As the system (20) is inserted in the borehole (24), any fluid within the borehole (24) may pass through the packer assembly bypass port (106) of the packer bypass device (100), which is in the open position. Further, any fluid within the borehole (24) may also pass through the running tool bypass port (198) of the running tool bypass device (194), which is also in the open position. The open positions of the packer bypass device (100) and the running tool bypass device (194), and the presence of the packer assembly bypass port (106) and the running tool bypass port (198) respectively therein, minimizes or decreases the potential for occurrence of a piston effect during the inserting step.

Various pressures are then applied to the interior (42) of the running tool (34) in order to perform the further steps or desired functions of the components of the system (20). For instance, a packer sealing actuating pressure may be applied in order to actuate the packer assembly (32) and a latch actuating pressure may be applied in order to disengage the packer assembly (32) from the running tool (34). Additionally, where desired, a packer bypass actuating pressure may optionally be applied in order to actuate the packer bypass device (100) to close the packer bypass port (106). Finally, a running tool bypass pressure may be applied to actuate the running tool bypass device (194) to close the running tool bypass port (198).

Each of these pressures may be applied separately or as different or distinct pressures in the interior (42) of the running tool (34). However, in the preferred embodiment, the packer bypass actuating pressure and the packer sealing actuating pressure are comprised of a combined actuating pressure. Accordingly, the application of the combined actuating pressure actuates both the packer bypass device (100) and the packer sealing device (36).

Figure 9:
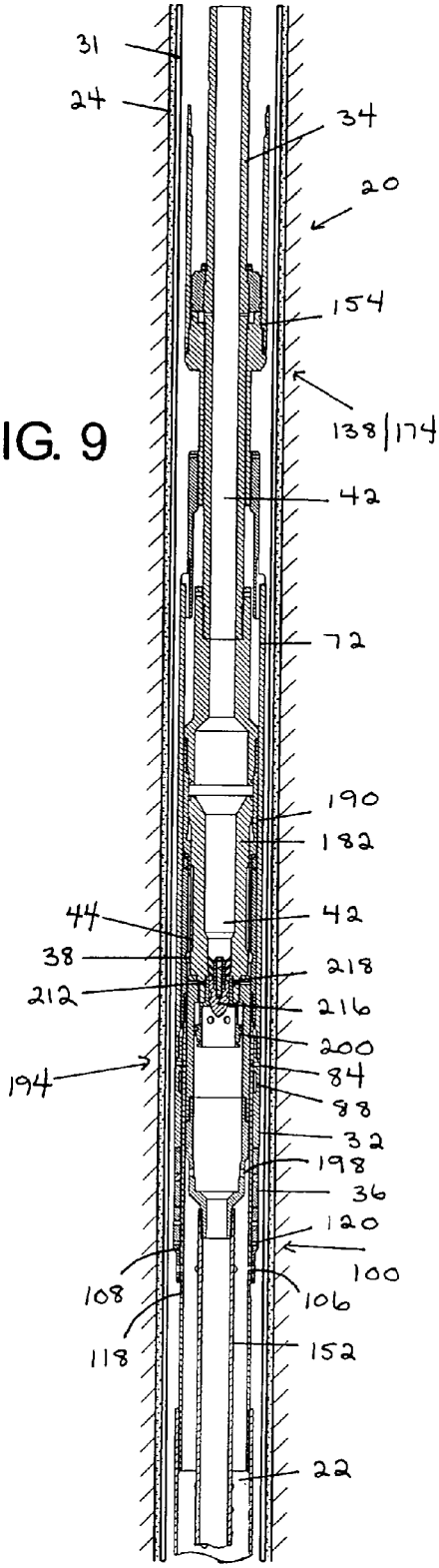

Further, in order to facilitate the application of the desired pressures in the interior (42) of the running tool (34), the method is preferably comprised of the step of obstructing the interior (42) of the running tool (34) as shown in FIG. 9. Thus, the obstructing step is preferably performed following the inserting step and positioning of the system (20) in the borehole (24). More particularly, the obstructing step is comprised of obstructing the interior (42) of the running tool (34) in order to facilitate the application of the packer sealing actuating pressure and the latch actuating pressure. Further, the obstructing step also preferably facilitates the application of one or both of the packer bypass actuating pressure and the running tool bypass actuating pressure. In the preferred embodiment, the method is comprised of the step of obstructing the interior (42) of the running tool (34) in order to facilitate the application of each of the packer sealing actuating pressure, the latch actuating pressure, the running tool bypass actuating pressure and the packer bypass pressure.

In the preferred embodiment, the obstructing step is comprised of inserting the setting plug (216) from the surface in the working string (40) connected with the running tool (34). Fluid is then pumped through the working string (40) from the surface to provide a fluid pressure sufficient to propel the setting plug (216) downhole to the running tool (34). The setting plug (216) is then landed within, and engaged with, the setting plug landing surface (218) in the interior (42) of the setting tool (34), and particularly in the running tool bypass valve (200).

Following the inserting step and the obstructing step, the method is comprised of the step of applying the packer sealing actuating pressure, which is preferably comprised of the combined actuating pressure, to the interior (42) of the running tool (34) in order to actuate the packer sealing device (36) to the expanded configuration in which the packer assembly (32) is sealed in the borehole (24). In addition, the method is preferably further comprised of the step of applying the packer bypass actuating pressure, which is preferably comprised of the combined actuating pressure, to the interior (42) of the running tool (34) in order to actuate the packer bypass device (100) to the closed position. Thus, in the preferred embodiment, the combined actuating pressure is applied to the interior (42) of the setting tool (34) to actuate the packer sealing device (36) to the expanded configuration and to actuate the packer bypass device (100) to the closed position, as shown in FIG. 10.

Specifically, the fluid pressure is increased from the surface to the combined actuating pressure, causing pressure within the running tool body (140) to be transmitted through the piston chamber port (172) into the piston chamber (166) of the actuating piston device (154). As a result, the thrust ring (160) of the actuating piston device (154) is forced downward, which axially moves the setting sleeve (72) downwards as the piston engagement surface (164) engages the proximal end (74) of the setting sleeve (72) of the packer assembly (32). The combined actuating pressure causes the shearing of both the shearable fastener (86) comprising the packer sealing restraining device (84) and the shearable fastener (122) comprising the packer bypass restraining device (120). The shearing of the shearable fasteners (86, 122) enables the setting sleeve (72) to move axially downward or downhole relative to the packer body (46) until the retainer ring (119) at the distal end (114) of the shutoff valve (110) engages or abuts against the stop shoulder (118). This axial movement causes the packer bypass valve (108), comprised of the shutoff sleeve (110), to block or close the packer bypass port (106), thus actuating the packer bypass device (100) to the closed position.

Further axial movement of the setting sleeve (72) downward causes the buckling or expansion of the sealing element (62), comprised of the annular seal members (66), along the sealing element axis (64), thus actuating the packer sealing device (36) to the expanded configuration. The setting sleeve (72) is restrained from moving back upwards or uphole relative to the packer body (46) by the packer locking mechanism (88) comprised of the ratchet mechanism (90) between the setting sleeve (72) and the packer body (46).

In addition, referring to FIG. 11, the method is comprised of the step of applying the latch actuating pressure to the interior (42) of the running tool (34) in order to disengage the packer latch device (38) from the running tool latch device (44), thereby disconnecting the packer assembly (32) from the running tool (34). Preferably, the packer assembly (32) is set in the expanded configuration in the borehole (24) prior to disengaging the packer assembly (32) from the running tool (32). Therefore, in the preferred embodiment, the step of applying the packer sealing actuating pressure is performed before the step of applying the latch actuating pressure.

Specifically, the fluid pressure is increased from the surface to the latch actuating pressure, causing the shearing of the shearable fastener (192), comprising the latch actuating restraining device (190), which connects the proximal section (150) of the running tool body (140) with the latch releasing piston (186) of the latch device actuator (182). This enables the latch releasing piston (186) to move axially downward or downhole relative to the collet (176) to enable the collet engagement surface (178) to drop into the collet retaining groove (188) defined by the latch releasing piston (186), and thereby disengage the collet engagement surface (178) from the latch groove (98) on the packer assembly (32). This results in the disengagement of the packer assembly (32) from the running tool (34).

Referring to FIG. 12, the running tool (34) is then preferably slightly lifted from the surface by the working string (40), about 0.5 meters to 1.0 meters, to ensure that the packer assembly (32) cannot re-engage with the running tool (34). Specifically, the lifting of the running tool (34) moves the collet (176) out of alignment with the latch groove (98).

In the preferred embodiment, referring to FIG. 13, the method is further comprised of the step of applying a running tool bypass actuating pressure to the interior (42) of the running tool (34) in order to actuate the running tool bypass device (194) to the closed position.

Specifically, the fluid pressure is increased from the surface to the running tool bypass actuating pressure, causing the shearing of the shearable fastener (214), comprising the running tool bypass restraining device (212), which connects the running tool bypass valve (200) with the running tool body (140). This enables the shutoff piston (204), comprising the running tool bypass valve (200), to move axially downward within the distal section (148) of the running tool body (140) to lodge or engage with the valve seat (210) at the distal end (144) of the running tool body (140). When the shutoff piston (204) is engaged with the valve seat (210), the shutoff piston (204) also blocks or closes the running tool bypass port (198) such that the running tool bypass device (194) is in the closed position. As a result, the circulating conduit (152) connected with the distal end (144) of the running tool body (140) is sealed from the annulus defined between the liner conduit (22) and the circulating conduit (152).

Following the step of actuating the running tool bypass device (194) to the closed position, the method may be further comprised of the step of passing a circulating fluid through the running tool (34) and the circulating conduit (152). Preferably, the step of passing the circulating fluid through the running tool (34) and the circulating conduit (152) is performed following both the step of actuating the running tool bypass device (194) to the closed position and the step of actuating the packer bypass device (100) to the closed position.

Figure 14:
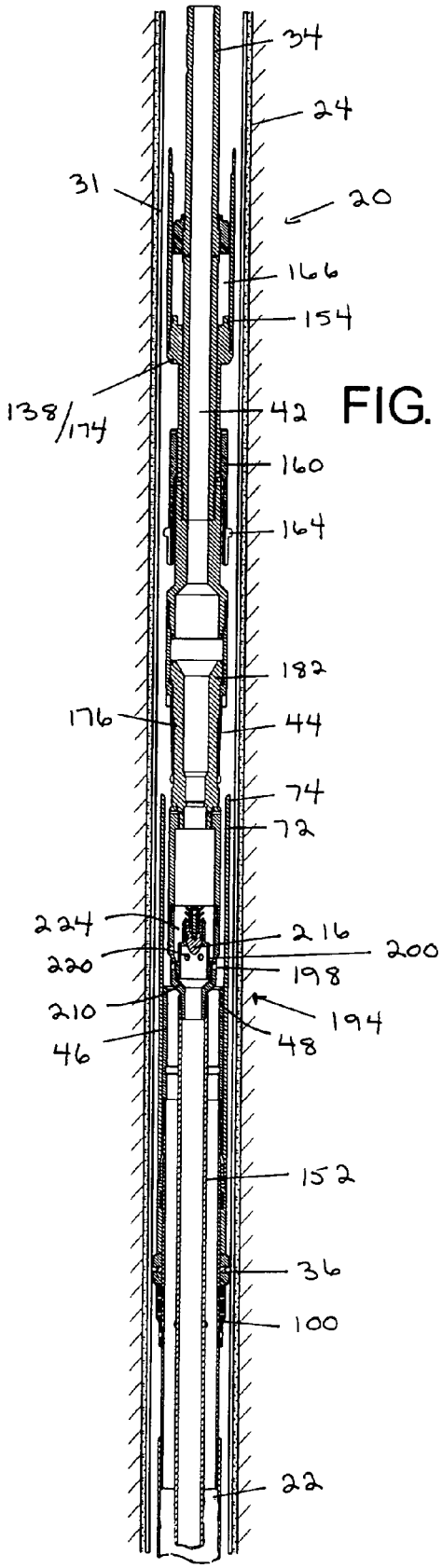

Specifically, a circulating or displacing fluid, such as water or completion fluid, may be pumped through the working string (40) from the surface to the running tool (34) and into the circulating conduit (152) in order to displace or flush the borehole (24) to remove drilling or other undesirable fluid which was previously left in place in the borehole (24) to prevent the collapse of the borehole (24).

Where the method is comprised of the step of passing the circulating fluid through the running tool (34) and the circulating conduit (152), the method may be further comprised of the step of lifting the running tool (34) relative to the liner conduit (22) before the circulating fluid passing step is performed, as shown in FIG. 14. This lifting step may be necessary in order to provide for a sufficient flowpath in the liner conduit (22) to permit the circulating fluid to move upward or uphole towards the surface through the liner conduit (22) as the circulating step is being conducted. For instance, it may be necessary to lift the running tool (34) such that the distal end (144) of the running tool body (140) is removed from or is positioned adjacent or uphole of the proximal end (48) of the packer body (46). In addition, to further enhance the uphole flow of fluids, it may be desirable to further lift the running tool (34) such that the distal end (144) of the running tool body (140) is removed from or is positioned adjacent or uphole of the proximal end (74) of the setting sleeve (72).

Finally, the method is preferably comprised of the step of removing the running tool (34) from the borehole (24). In addition, where the circulating conduit (152) is utilized, the method is comprised of the step of removing the running tool (34) and the circulating conduit (152) from the borehole (24). Specifically, once the fluid in the borehole (24) has been displaced or flushed, the running tool (34) with the circulating conduit (152) connected thereto may be concurrently removed from the borehole (24), leaving the packer assembly (32) with the liner conduit (22) connected thereto in place in the borehole (24).

While preferred embodiments have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A system for installing a liner conduit in a borehole, the system comprising a packer assembly adapted for insertion in the borehole with a running tool, the packer assembly comprising:

(a) a packer sealing device, the packer sealing device being adapted to be actuatable from a collapsed configuration for positioning the packer assembly in the borehole to an expanded configuration for sealing the packer assembly in the borehole by the application of a packer sealing actuating pressure to an interior of the running tool;

(b) a packer latch device adapted to releasably engage a complementary running tool latch device on the running tool in order to releasably connect the packer assembly with the running tool, the packer latch device being adapted to disengage from the running tool latch device in order to disconnect the packer assembly from the running tool by the application of a latch actuating pressure to the interior of the running tool; and (c) a packer bypass device for bypassing a fluid from an exterior of the packer assembly to an interior of the packer assembly, the packer bypass device being adapted to be actuatable from an open position to a closed position by the application of a packer bypass actuating pressure to an interior of the running tool.

2. The system as claimed in claim 1 wherein the packer bypass device is comprised of a packer bypass port and wherein the packer bypass device is further comprised of a packer bypass valve.

3. The system as claimed in claim 2 wherein the packer assembly is further comprised of a tubular packer body, wherein the packer body defines the packer bypass port, and wherein the packer bypass valve is comprised of a movable shutoff sleeve carried by the packer body.

4. The system as claimed in claim 3 wherein the shutoff sleeve is axially movable relative to the packer body in response to the application of the packer bypass actuating pressure in order to actuate the packer bypass device from the open position to the closed position.

5. The system as claimed in claim 4 wherein the packer bypass device is further comprised of a packer bypass restraining device for restraining axial movement of the shutoff sleeve relative to the packer body before the application of the packer bypass actuating pressure.

6. The system as claimed in claim 5 wherein the packer bypass restraining device is comprised of a shearable fastener.

7. The system as claimed in claim 4 wherein the packer sealing device is comprised of an expandable sealing element and wherein the packer sealing device is actuated to the expanded configuration by expanding the sealing element.

8. The system as claimed in claim 7 wherein the packer assembly is further comprised of a setting sleeve carried by the packer body, and wherein the setting sleeve is axially movable relative to the packer body in response to the application of the packer sealing actuating pressure in order to expand the sealing element and theirby actuate the packer sealing device to the expanded configuration.

9. The system as claimed in claim 8 wherein the sealing element defines a sealing element axis and wherein the sealing element is axially compressed by the setting sleeve in response to the application of the packer sealing actuating pressure, thereby expanding the sealing element and actuating the packer sealing device to the expanded configuration.

10. The system as claimed in claim 9 wherein the shutoff sleeve and the setting sleeve are associated such that axial movement of the shutoff sleeve is caused by axial movement of the setting sleeve.

11. The system as claimed in claim 10 wherein the sealing element is axially positioned between the shutoff sleeve and the setting sleeve so that the sealing element is axially compressed between the shutoff sleeve and the setting sleeve in response to the application of the packer sealing actuating pressure.

12. The system as claimed in claim 11 wherein the packer assembly is further comprised of a packer sealing restraining device for restraining axial movement of the setting sleeve relative to the packer body before the application of the packer bypass actuating pressure.

13. The system as claimed in claim 12 wherein the packer sealing restraining device is comprised of a shearable fastener for fastening the setting sleeve to the packer body.

14. The system as claimed in claim 13 wherein the packer bypass actuating pressure and the packer sealing actuating pressure are comprised of a combined actuating pressure such that the application of the combined actuating pressure actuates both the packer bypass device and the packer sealing device.

15. The system as claimed in claim 1 wherein the packer sealing device is comprised of an expandable sealing element and wherein the packer sealing device is actuated to the expanded configuration by expanding the sealing element.

16. The system as claimed in claim 15 wherein the packer assembly is further comprised of a tubular packer body, wherein the packer assembly is further comprised of a movable setting sleeve carried by the packer body.

17. The system as claimed in claim 16 wherein the setting sleeve is axially movable relative to the packer body in response to the application of the packer sealing actuating pressure, wherein the sealing element defines a sealing element axis and wherein the sealing element is axially compressed by the setting sleeve in response to the application of the packer sealing actuating pressure, thereby expanding the sealing element and actuating the packer sealing device to the expanded configuration.

18. The system as claimed in claim 17 wherein the packer sealing device is further comprised of a packer sealing restraining device for restraining axial movement of the setting sleeve relative to the packer body before the application of the packer sealing actuating pressure.

19. The system as claimed in claim 18 wherein the packer sealing restraining device is comprised of a shearable fastener for fastening the setting sleeve to the packer body.

20. The system as claimed in claim 17 wherein the packer assembly is further comprised of a packer locking mechanism for locking the packer sealing device in the expanded con figuration.

21. The system as claimed in claim 20 wherein the packer locking mechanism is comprised of a ratchet mechanism associated with the packer body and the setting sleeve.

22. The system as claimed in claim 1 wherein the packer assembly is further comprised of a tubular packer body, wherein an interior surface of the packer body defines a latch groove, and wherein the packer latch device is comprised of the latch groove.

23. The system as claimed in claim 1 wherein the packer assembly is further comprised of a packer torque transfer surface, wherein the packer torque transfer surface is adapted to engage with a complementary running tool torque transfer surface so that a torque exerted on the running tool may be transferred to the packer assembly.

24. The system as claimed in claim 23 wherein the packer torque transfer surface is comprised of packer splines which are adapted to engage complementary running tool splines.

25. The system as claimed in claim 24 wherein the packer assembly is further comprised of a tubular packer body and wherein the packer splines are associated with the packer body.

26. The system as claimed in claim 1, further comprising the liner conduit, wherein the liner conduit is connected with the packer assembly.

27. The system as claimed in claim 26 wherein the liner conduit is a perforated liner conduit.

28. The system as claimed in claim 27 wherein the packer assembly is further comprised of a tubular packer body and wherein the liner conduit is connected with the packer body so that the packer body and the liner conduit define a continuous passage therethrough.

29. A system for installing a liner conduit in a borehole, the system comprising a running tool adapted for insertion in the borehole with a packer assembly, the packer assembly comprising a packer sealing device and a packer latch device, the ruining tool comprising:

(a) a packet sealing device actuator adapted to actuate the packer sealing device from a collapsed configuration to an expanded configuration in response to the application of a packer sealing actuating pressure to an interior of the running tool;

(b) a running tool latch device adapted to releasably engage a complementary packer assembly latch device on the packer assembly in order to releasably connect the running tool with the packer assembly, the running tool latch device being adapted to disengage from the packer assembly latch device in order to disconnect the running tool from the packer assembly by the application of a latch actuating pressure to the interior of the running tool;

(c) wherein the packer assembly is further comprised of a packer bypass device and wherein the running tool is further comprised of a packer bypass device actuator adapted to actuate the packer bypass device from an open position to a closed position in response to the application of a packer bypass actuating pressure to an interior of the running tool.

30. The system as claimed in claim 29 wherein the running tool is further comprised of a tubular running tool body and wherein the packer bypass device actuator is comprised of a movable actuating piston device carried by the running tool body.

31. The system as claimed in claim 30 wherein the actuating piston device is axially movable relative to the running tool body in response to the application of the packer bypass actuating pressure.

32. The system as claimed in claim 31 wherein the running tool body and the actuating piston device define a piston chamber and wherein the running tool body defines a piston chamber port extending between the interior of the running tool and the piston chamber for communicating the packer bypass actuating pressure to the piston chamber.

33. The system as claimed in claim 32 wherein the actuating piston device is comprised of a piston engagement surface for engaging with the packer assembly in order to actuate the packer bypass device from the open position to the closed position.

34. The system as claimed in claim 29 wherein the running tool is further comprised of a tubular running tool body and wherein the packer sealing device actuator is comprised of a movable actuating pistil device carried by the running tool body.

35. The system as claimed in claim 34 wherein the actuating piston device is axially movable relative to the running tool body in response to the application of the packer sealing actuating pressure.

36. The system as claimed in claim 35 wherein the running tool body and the actuating piston device define a piston chamber and wherein the running tool body defines a piston chamber port extending between the interior of the running tool and the piston chamber for communicating the packer sealing actuating pressure to the piston chamber.

37. The system as claimed in claim 36 wherein the actuating piston device is comprised of a piston engagement surface for engaging with the packer assembly in order to actuate the packer sealing device from the collapsed configuration to the expanded configuration.

38. The system as claimed in claim 37 wherein the packer bypass device actuator is comprised of the actuating piston device.

39. The system as claimed in claim 38 wherein the packer bypass actuating pressure and the packer sealing actuating pressure are comprised of a combined actuating pressure such that the application of the combined actuating pressure actuates both the packer bypass device and the packer sealing device.

40. The system as claimed in claim 29 wherein the running tool is further comprised of a latch device actuator adapted to disengage the running tool latch device from the packer assembly latch device in response to the application of the latch actuating pressure to the interior of the running tool.

41. The system as claimed in claim 40 wherein the running tool latch device is comprised of a collet which is adapted to engage a latch groove on the packer assembly.

42. The system as claimed in claim 41 wherein the running tool is further comprised of a tubular running tool body and wherein the latch device actuator is comprised of a movable latch actuating member carried by the running tool body.

43. The system as claimed in claim 42 wherein the latch actuating member is comprised of a latch releasing piston contained within the running tool body and wherein the latch releasing piston is axially movable relative to the running tool body in response to the application of the latch actuating pressure in order to disengage the collet from the latch groove.

44. The system as claimed in claim 43 wherein the latch releasing piston defines a collet retaining groove and wherein axial movement of the latch releasing piston causes the collet to enter the collet retaining groove and thereby disengage from the latch groove.

45. The system as claimed in claim 43 wherein the latch device actuator is further comprised of a latch actuating restraining device for restraining axial movement of the latch releasing relative to the running tool body before the application of the latch actuating pressure.

46. The system as claimed in claim 45 wherein the latch activating restraining device is comprised of a shearable fastener.

47. The system as claimed in claim 29 wherein the running tool is further comprised of a running tool bypass device for bypassing a fluid from all exterior of the RTL) king tool to the interior of the running tool, the running tool bypass device being actuatable from an open position to a closed position by the application of a running tool bypass actuating pressure to the interior of the running tool.

48. The system as claimed in claim 47 wherein the packer assembly is further comprised of a packer bypass device and wherein the running tool is further comprised of a packer bypass device actuator adapted to actuate the packer bypass device from an open position to a closed position in response to the application of a packer bypass actuating pressure to an interior of the running tool.

49. The system as claimed in claim 47 wherein the running tool bypass device is comprised of a running tool bypass port and wherein the running tool bypass device is further comprised of a running tool bypass valve.

50. The system as claimed in claim 49 wherein the running tool is FTIR comprised of a tubular running tool body, wherein the running tool body defines the running tool bypass port and wherein the running tool bypass valve is comprised of a movable shutoff member called by the running tool body.

51. The system as claimed in claim 50 wherein the shutoff member is comprised of a shutoff piston contained within the running tool body and wherein the shutoff piston is axially movable relative to the running tool body in response to the application of the running tool bypass actuating pressure in order to close the running tool bypass port.

52. The system as claimed in claim 51 wherein the running tool bypass device is further comprised of a running tool bypass restraining device for restraining axial movement of the shutoff piston relative to the running tool body before the application of the running tool bypass actuating pressure.

53. The system as claimed in claim 52 wherein the running tool bypass restraining device is comprised of a shearable fastener.

54. The system as claimed in claim 47, further comprising a circulating conduit, wherein the circulating conduit is connected with the running tool.

55. The system as claimed in claim 54 wherein the running tool is further comprised of a tubular running tool body and wherein the circulating conduit is connected with the running tool so that the running tool body and the circulating conduit define a continuous passage therethrough.

56. The system as claimed in claim 29 wherein the interior of the running tool is comprised of a setting plug landing surface and wherein the setting plug landing surface is adapted to accept a setting plug which is passed through the interior of the running tool in order to obstruct the interior of the running tool.

57. The system as claimed in claim 56 wherein the running tool is further comprised of a running tool bypass device for bypassing a fluid from an exterior of the running tool to the interior of the running tool, the running tool bypass device being actuatable from an open position to a closed position by the application of a running tool bypass actuating pressure to the interior of the running tool.

58. The system as claimed in claim 57 wherein the running tool bypass device is comprised of a running tool bypass port and wherein the running tool bypass device is further comprised of a running tool bypass valve.

59. The system as claimed in claim 58 wherein the setting plug landing surface is associated with the running tool bypass valve.

60. The system as claimed in claim 59 wherein the running tool bypass valve defines a bypass valve flowbore extending therethrough and wherein the setting plug landing surface is associated with the bypass valve flowbore so that the setting plug will obstruct the bypass valve flowbore.

61. The system as claimed in claim 60 wherein the running tool bypass valve defines a circulating port extending from an exterior of the running tool bypass valve to the bypass valve flowbore, wherein the running tool bypass device is further comprised of a bypass chamber and wherein the bypass chamber is configured so that a circulating fluid may be passed through the circulating port when the setting plug is landed in the setting plug landing surface and the running tool bypass device is in the closed position.

62. The system as claimed in claim 61, further comprising a circulating conduit, wherein the circulating conduit is connected with the running tool.

63. The system as claimed in claim 62 wherein the running tool is further comprised of a tubular running tool body and wherein the circulating conduit is connected with the running tool so that the running tool body and the circulating conduit define a continuous passage therethrough.

64. The system as claimed in claim 29 wherein the running tool is further comprised of a running tool torque transfer surface, wherein the running tool torque transfer surface is adapted to engage with a complementary packer assembly torque transfer surface so that a torque exerted on the running tool may be transferred to the packer assembly.

65. The system as claimed in claim 64 wherein the running tool torque transfer surface is comprised of running tool splines which are adapted to engage complementary packer assembly splines.

66. The system as claimed in claim 65 wherein the running tool is further comprised of a tubular running tool body and wherein the running tool splines are associated with the running tool body.

67. The system as claimed in claim 29, further comprising the packer assembly, wherein the packer assembly comprises:

(a) a packer sealing device, the packer sealing device being adapted to be actuatable from a collapsed configuration for positioning the packer assembly in the borehole to an expanded configuration for sealing the packer assembly in the borehole by the application of a packer sealing actuating pressure to the interior of the running tool; and (b) a packer latch device adapted to releasably engage a complementary running tool latch device on the running tool in order to releasably connect the packer assembly with the running tool, the packer latch device being adapted to disengage from the running tool latch device in order to disconnect the packer assembly from the running tool by the application of a latch actuating pressure to the interior of the running tool.

68. The system as claimed in claim 67 wherein the running tool is further comprised of a running tool bypass device for bypassing a fluid from an exterior of the running tool to the interior of the running tool, the running tool bypass device being actuatable from an open position to a closed position by the application of a running tool bypass actuating pressure to the interior of the running tool.

69. A method for installing a liner conduit in a borehole, comprising:

(a) inserting a system comprising the liner conduit, a packer assembly and a running tool in the borehole, the packer assembly comprising a packer sealing device, packer latch device, and a packer bypass device for bypassing a fluid from an exterior of the packer assembly to an interior of the packer assembly, the running tool comprising a packer sealing device actuator and a running tool latch device, the liner conduit connected with the packer assembly, the packer assembly releasably connected with the running tool;

(b) applying a packer sealing actuating pressure to an interior of the running tool in order to actuate the packer sealing device to an expanded configuration in which the packer assembly is sealed in the borehole;

(c) applying a latch actuating pressure to the interior of the running tool in order to disengage the packer latch device from the running tool latch device, thereby disconnecting the packer assembly from the running tool and;

(d) applying a packer bypass actuating pressure to the interior of the running tool in order to actuate the packer bypass device to a closed position.

70. The method as claimed in claim 69, further comprising the step of obstructing the interior of the running tool in order to facilitate the application of the packer sealing actuating pressure, the latch actuating pressure and the packer bypass actuating pressure.

71. The method as claimed in claim 70, further comprising the step of removing the running tool from the borehole.

72. The method as claimed in claim 71 wherein the step of applying the packer sealing actuating pressure is performed before the step of applying the latch actuating pressure.

73. The method as claimed in claim 72 wherein the packer bypass actuating pressure and the packer sealing actuating pressure are comprised of a combined actuating pressure such that the application of the combined actuating pressure actuates both the packer bypass device and the packer sealing device.

74. The method as claimed in claim 69 wherein the running tool is further comprised of a running tool bypass device for bypassing a fluid from an exterior of the running tool to the interior of the running tool, further comprising the step of applying a running tool bypass actuating pressure to the interior of the running tool in order to actuate the running tool bypass device to a closed position.

75. The method as claimed in claim 74, further comprising the step of obstructing the interior of the running tool in order to facilitate the application of the packer sealing actuating pressure, the latch actuating pressure and the running tool bypass actuating pressure.

76. The method as claimed in claim 75 wherein the system is further comprised of a circulating conduit connected with the running tool, further comprising the step of passing a circulating fluid through the running tool and the circulating conduit following the step of actuating the running tool bypass device to the closed position.

77. The method as claimed in claim 76, further comprising the step of removing the running tool and the circulating conduit from the borehole.

78. The method as claimed in claim 77 wherein the step of applying the packer sealing actuating pressure is performed before the step of applying the latch actuating pressure.

79. The method as claimed in claim 74, further comprising the step of obstructing the interior of the running tool in order to facilitate the application of the packer sealing actuating pressure, the latch actuating pressure, the running tool bypass actuating pressure and the packer bypass pressure.

80. The method as claimed in claim 79 wherein the system is further comprised of a circulating conduit connected with the running tool, further comprising the step of passing a circulating fluid through the running tool and the circulating conduit following the steps of actuating the running tool bypass device to the closed position and actuating the packer bypass device to the closed position.

81. The method as claimed in claim 80, further comprising the step of removing the running tool and the circulating conduit from the borehole.

82. The method as claimed in claim 81 wherein the step of applying the packer sealing actuating pressure is performed before the step of applying the latch actuating pressure.

83. The method as claimed in claim 82 wherein the packer bypass actuating pressure and the packer scaling actuating pressure are comprised of a combined actuating pressure such that the application of the combined actuating pressure actuates both the packer bypass device and the packer sealing device.

* * * * *